US010907265B2

(12) United States Patent
Wan et al.

(10) Patent No.: US 10,907,265 B2
(45) Date of Patent: Feb. 2, 2021

(54) FLOW-REGULATED GROWTH OF NANOTUBES

(71) Applicants: Jiandi Wan, Pittsford, NY (US); Rong Fan, Rochester, NY (US); Zihao Wang, Rochester, NY (US)

(72) Inventors: Jiandi Wan, Pittsford, NY (US); Rong Fan, Rochester, NY (US); Zihao Wang, Rochester, NY (US)

(73) Assignee: Rochester Institute of Technology, Rochester, NY (US)

( * ) Notice: Subject to any disclaimer, the term of this patent is extended or adjusted under 35 U.S.C. 154(b) by 0 days.

(21) Appl. No.: 15/669,034

(22) Filed: Aug. 4, 2017

(65) Prior Publication Data

US 2018/0038006 A1 Feb. 8, 2018

Related U.S. Application Data

(60) Provisional application No. 62/435,929, filed on Dec. 19, 2016, provisional application No. 62/371,033, filed on Aug. 4, 2016.

(51) Int. Cl.

| | |
|---|---|
| ***C25D 11/26*** | (2006.01) |
| ***C25D 1/00*** | (2006.01) |
| ***C25D 11/04*** | (2006.01) |

(52) U.S. Cl.

CPC ..... *C25D 1/006* (2013.01); *C25D 11/04* (2013.01); *C25D 11/26* (2013.01)

(58) Field of Classification Search

None

See application file for complete search history.

(56) References Cited

U.S. PATENT DOCUMENTS 5,700,366 A * 12/1997 Steblianko ..... C25D 5/08 205/102
2003/0059992 A1* 3/2003 Cotte ..... H01C 17/262 438/190

OTHER PUBLICATIONS

Bhattacharya J., et al., "Microfluidic anodization of aluminum films for the fabrication of nanoporous lipid bilayer support structures", Beilstein Journal of Nanotechnology, 2011, 2, 104-109. (Year: 2011).*

Aerts, T., et al., "Experimental study and modeling of heat transfer during anodizing in a wall-jet set-up", Simulation of Electrochemical Processes II, vol. 54, 193-202, 2007. (Year: 2007).*

Krivec, M., et al., "Highly Efficient TiO2-based microreactor for photocatalytic applications", ACS Applied Materials & Interfaces, 2013, 5, 9088-9094. (Year: 2013).*

(Continued)

*Primary Examiner* — Stefanie S Wittenberg

(74) *Attorney, Agent, or Firm* — Bond, Schoeneck & King, PLLC; Joseph Noto

(57) ABSTRACT

A method for growing nanotubes via flow-regulated microfluidic electrochemical anodization, includes providing a microfluidic device having a fluid inlet; a fluid outlet; and a fluidic microchannel connecting the fluid inlet and outlet, wherein the microchannel includes a Pt cathode and a Ti anode separated by an electrical insulator; providing an electrolyte fluid flow through the microchannel; and providing an electrical current across the anode and cathode sufficient to cause electrochemical anodization growth of $TiO_2$ nanotubes in the microchannel on a surface of the anode.

10 Claims, 55 Drawing Sheets

(56) References Cited

OTHER PUBLICATIONS

Raoufi, M., et al., "Improved synthesis of anodized aluminum oxide with modulated pore diameters for the fabrication of polymeric nanotubes", RSC Advances, 2013, 3, 13429-13436. (Year: 2013).*
Lamberti et al. "Microfluidic electrochemical growth of vertically aligned TiO2 nanotubes for SERS optofluidic devices", RSC Advances, 2015, 5, 105484-105488 (Year: 2015).*

* cited by examiner

FIG. 8A
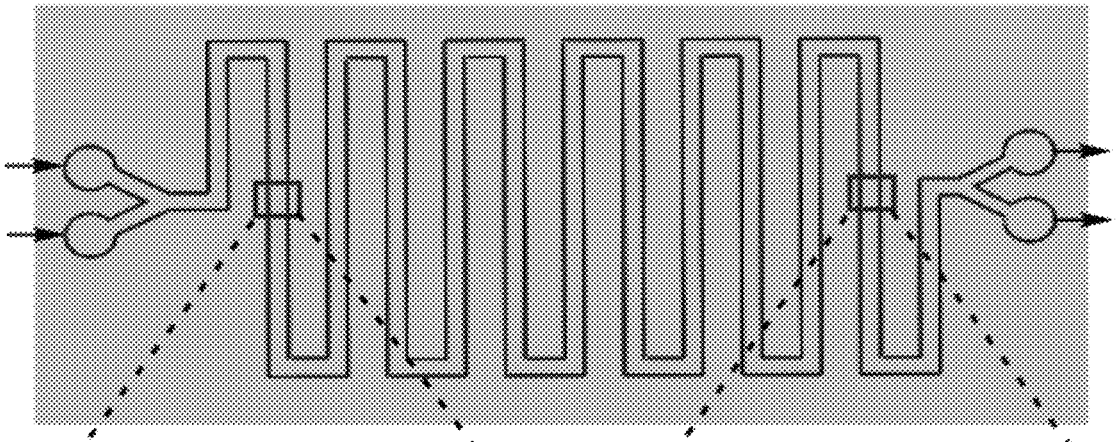
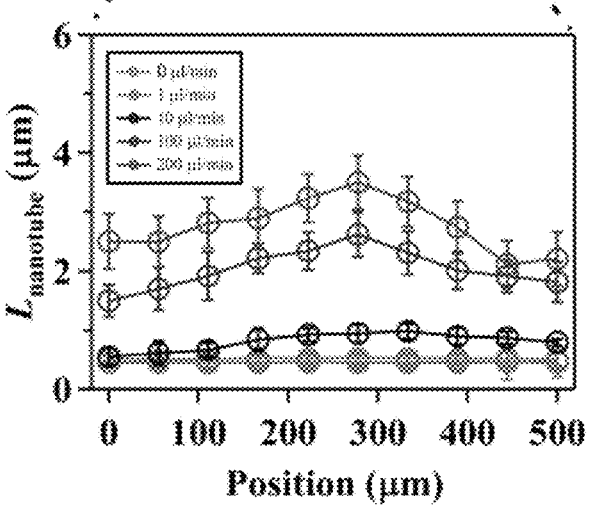
FIG. 8B
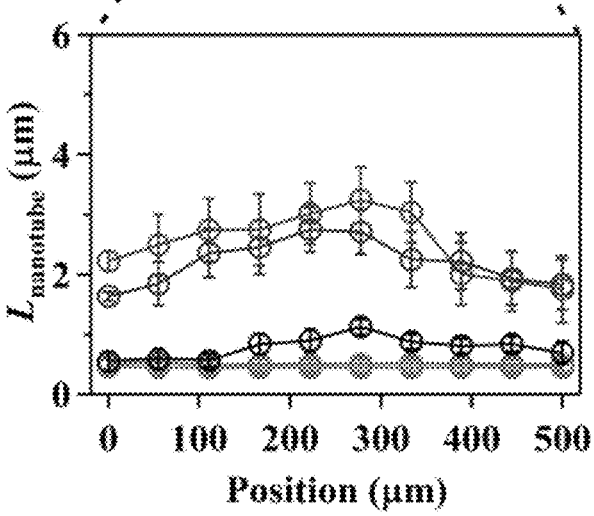
FIG. 8C

FIG. 9A
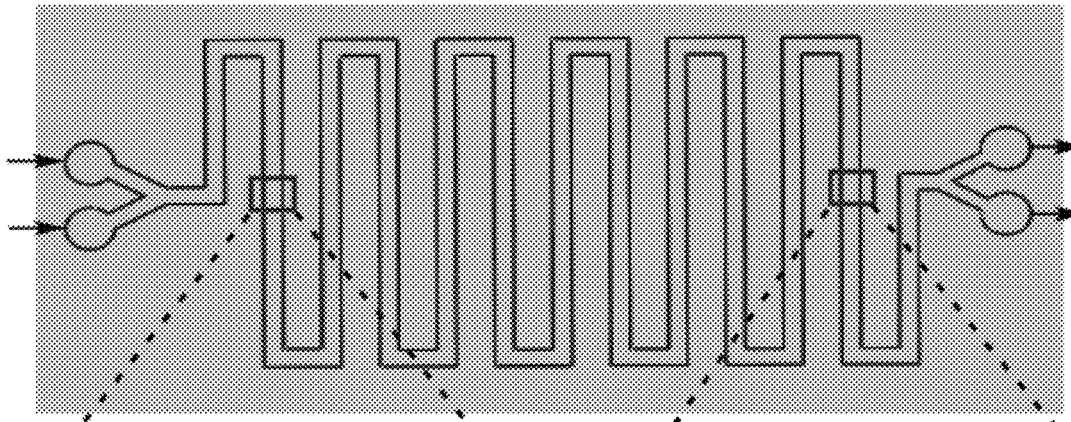
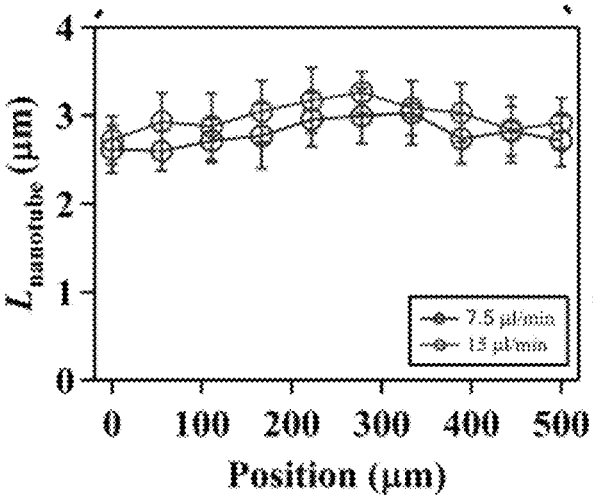
FIG. 9B
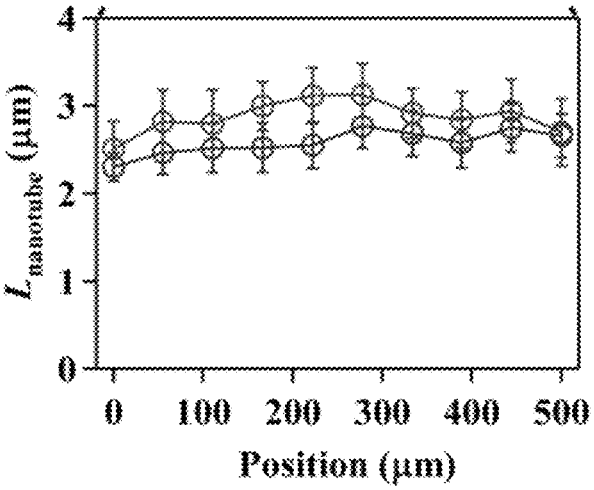
FIG. 9C

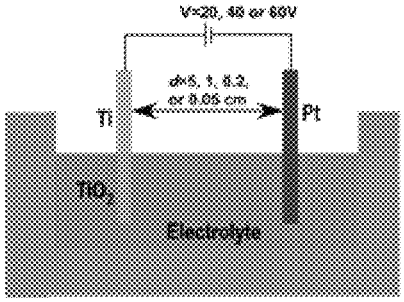
FIG. 14A
FIG. 14B
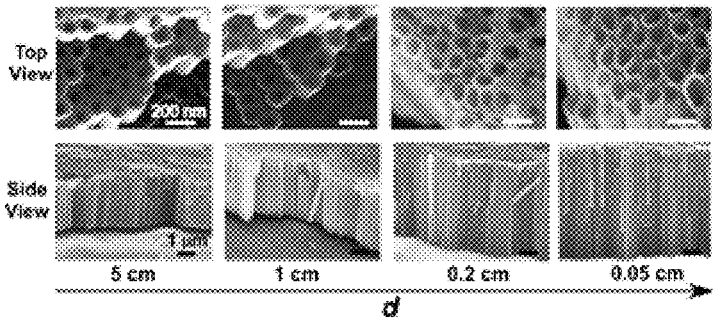
FIG. 14C

FLOW-REGULATED GROWTH OF NANOTUBES

RELATED APPLICATION DATA

This application claims the benefit of priority of U.S. Provisional Patent Application No. 62/435,929 filed on Dec. 19, 2016 and U.S. Provisional Patent Application No. 62/371,033 filed on Aug. 4, 2016, the subject matter of all being incorporated herein by reference in their entireties.

STATEMENT REGARDING FEDERALLY SPONSORED RESEARCH FOR DEVELOPMENT

This invention was made with Government support under Agency Grant No. 56679 awarded by NYSERDA. The government has certain rights in the invention.

FIELD

This disclosure relates to flow-regulated growth of nanotubes, and in particular, to methods and devices for flow-regulated growth of nanotubes via electrochemical anodization.

BACKGROUND

Due to the inherent material properties of $TiO_2$ and unique features of nanotubes, $TiO_2$ nanotubes find a wide range of applications including but not limited to photo-catalysis, solar cells, electrochromic devices, sensors, bio-coating, and drug delivery. Although many approaches such as sol-gel, electrochemical lithography, and hydrothermal synthesis have been developed to produce $TiO_2$ nanotubes, anodic growth of $TiO_2$ nanotubes is one of the most common methods to produce highly ordered nanotube arrays. $TiO_2$ nanotubes are commonly grown using electrochemical anodization, in which a complex field-aided oxidation and dissolution process is responsible for the formation of $TiO_2$ nanotubes. During anodization, titanium metal is oxidized to a $TiO_2$ layer on the top of the metal surface, which is subsequently dissolved via a field-assisted electrochemical process to produce the $TiO_2$ nanotubes. The continuous competition of the field-assisted oxidation and dissolution is believed to control the growth of $TiO_2$ nanotube arrays.

To date, all the approaches used to grow $TiO_2$ nanotubes are conducted in bulk conditions, e.g., with a relatively large distance (>5 cm) between the anode and cathode. In these cases, it takes long time (tens of hours) to grow long (in the ranges of micrometers) nanotubes and there is always an oxide layer on top of the synthesized nanotubes, compromising the applications of such $TiO_2$ nanotubes. To date, most approaches to electrochemically produce $TiO_2$ nanotubes are conducted under static, bulk conditions during anodization. In this case, an initially formed, compact oxide layer with random pores often remains on the top of the $TiO_2$ nanotube arrays after anodization. The existence of the compact oxide layer significantly limits the growth and application of $TiO_2$ nanotubes. In addition, extended anodization time, which is required to produce long $TiO_2$ nanotubes (e.g., high aspect ratios), frequently leads to inhomogeneous tube diameter and structure due to the F-based chemical etching process. Introducing hydrodynamic factors such as stirring to the electrolyte solution during anodization increases the length of $TiO_2$ nanotubes up to 60%, the flow, however, is not well-controlled and the morphological homogeneity of nanotubes is negatively affected.

In addition, although stirring the electrolyte solution during anodization has shown to be able to increase the length of $TiO_2$ nanotubes, the solution flow is not well controlled and the morphological homogeneity of the $TiO_2$ nanotubes is negatively affected. As a result, stagnant solutions are preferred for the growth of uniform layers.

Thus, the art lacks a method in which the rate of anodic growth of $TiO_2$ nanotubes is significantly enhanced. A method which controls the diameter, length, and crystal orientations of $TiO_2$ nanotubes and determines the spatial distribution of nanotubes is also desired. Further lacking is a method in which both vertically and horizontally aligned $TiO_2$ nanotubes can be produced. The present invention provides regulation of the growth of $TiO_2$ nanotubes and effective strategies to enhance the production of $TiO_2$ nanotubes with controlled orientation and structural properties in a manner not suggested or contemplated by the art.

SUMMARY

In accordance with an aspect of the present invention, there is provided a method for growing nanotubes via flow-regulated electrochemical anodization, including flowing in a laminar flow an electrolyte between a metal anode and metal cathode; and providing an electrical current across the anode and cathode sufficient to cause electrochemical anodization growth of nanotubes on a surface of the anode, wherein the laminar flow has a flow rate sufficient to inhibit growth of an oxide layer on the nanotubes.

In accordance with another aspect of the present invention, there is provided a device for growing nanotubes via flow-regulated electrochemical anodization, including: a fluid inlet; a fluid outlet; and a channel connecting the fluid inlet and fluid outlet, wherein the channel includes a metal cathode and a metal anode separated by an electrical insulator, wherein the channel is capable of receiving a laminar flow of electrolytic fluid at a flow rate sufficient to cause electrochemical anodization growth of nanotubes on a surface of the anode and inhibit growth of an oxide layer on the nanotubes when an electrical current is placed across the anode and cathode.

BRIEF DESCRIPTION OF THE DRAWINGS

FIG. 1A is a schematic, FIG. 1B is an image of an embodiment of an assembled microfluidic device, FIG. 1C is an SEM image, FIG. 1D is a graph, FIG. 1E is a graph, FIG. 1F is a graph, FIG. 1G is a graph, FIGS. 1H & 1I are SEM images, FIGS. 1J & 1K are SEM images, FIG. 1L shows XRD patterns, and FIG. 1M is a graph;

FIG. 2A shows current-time curves, FIG. 2B is a graph, FIG. 2C is a graph, and FIG. 2D illustrates a schematic;

FIG. 3A is a schematic, FIG. 3B is a graph, FIG. 3C is a graph, FIG. 3D is a series of SEM images, FIG. 3E is a series of SEM images, FIG. 3F is a schematic, FIG. 3G is a graph, FIG. 3H is a graph, FIG. 3I is a series of SEM images, and FIG. 3J is a series of SEM images;

FIG. 4A is a schematic, FIG.

4B is a series of SEM images, FIG. 4C are high resolution SEM images, FIG. 4D is a schematic, FIG. 4E is an SEM image, FIGS. 4F & 4G are graphs, and FIG. 4H is a schematic;

FIG. 5A is an SEM image, FIG. 5B is an SEM image, and FIG. 5C is a graph;

FIGS. 6A & 6B are SEM images;

FIGS. 8A-8C shows the effect of flow on the spatial growth of $TiO_2$ nanotubes in microfluidics at different locations along the microfluidic channel, FIG. 8A is a schematic, FIG. 8B and FIG. 8C are plots;

FIGS. 9A-9C shows the effect of flow on the spatial growth of $TiO_2$ nanotubes in microfluidics at different locations along the microfluidic channel, FIG. 9A is a schematic, FIG. 9B and FIG. 9C are plots;

FIG. 10A shows a schematic and SEM image, FIG. 10B shows a schematic and SEM image, and FIG. 10C shows a schematic and SEM image;

FIG. 12A is a set of SEM images and FIG. 12B is a set of SEM images;

FIGS. 14A-14C illustrate electrode distance regulates the anodic growth of $TiO_2$ nanotube, FIG. 14A shows a schematic, FIG. 14B is a series of SEM images, and FIG. 14C is a series of SEM images;

FIG. 15A is a plot, FIG. 15B is a plot, and FIG. 15C is a plot;

FIG. 16A shows a graph and FIG. 16B shows a plot; FIG. 17A shows a plot, FIG. 17B shows a plot, and FIG. 17C shows a plot.

DETAILED DESCRIPTION

Figure 1A:
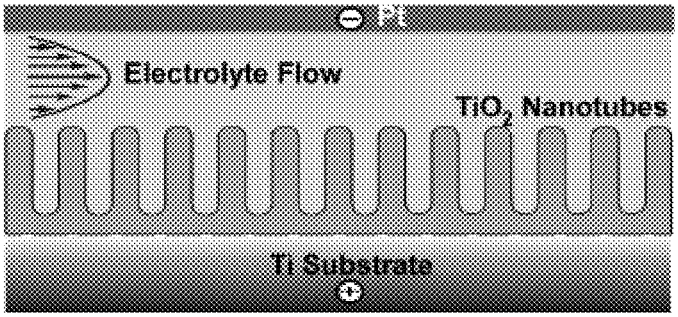
FIGS. 1A-1M illustrates the effect of flow on the growth of $TiO_2$ nanotubes in microfluidics.

The present invention provides a method and device wherein the flow associated with the growth of nanotubes is well controlled and flow rate can be changed systematically to affect a desired outcome. Suitable control is provided by a system using laminar flow, and in particular, 2-D laminar flow of the electrolyte solution. In addition, this method and system significantly decreases production time and improves product (e.g., without forming the oxide layer). Most importantly, this invention allows for growing $TiO_2$ nanotubes in a horizontal direction, which will open doors for the manipulation of spatial growth of nanotubes in hierarchical structures and fabrication of nano/micro devices involving horizontal $TiO_2$ nanotubes.

A method for growing nanotubes via flow-regulated electrochemical anodization, includes flowing in a laminar flow an electrolyte between a metal anode and metal cathode; and providing an electrical current across the anode and cathode sufficient to cause electrochemical anodization growth of nanotubes on a surface of the anode, wherein the laminar flow has a flow rate sufficient to inhibit growth of an oxide layer on the nanotubes.

A device for growing nanotubes via flow-regulated electrochemical anodization, includes: a fluid inlet; a fluid outlet; and a channel connecting the fluid inlet and fluid outlet, wherein the channel includes a metal cathode and a metal anode separated by an electrical insulator, and wherein the channel is capable of receiving a laminar flow of electrolytic fluid at a flow rate sufficient to cause electrochemical anodization growth of nanotubes on a surface of the anode and inhibit growth of an oxide layer on the nanotubes when an electrical current is placed across the anode and cathode.

This invention significantly accelerates the process of $TiO_2$ nanotubes growth and improves the quality of nanotubes by simultaneously removing the oxide layer while growing the nanotubes. Suitable electrolyte compositions include known electrolytes used for anodization.

An embodiment includes a microfluidic approach to grow, for example, $TiO_2$ nanotubes, via electrochemical anodization. The method is not limited to the growth of $TiO_2$ nanotubes and applies to any metals in which nanotubes can be grown via electrochemical anodization. Suitable metals include valve metals or any metals that build self-protecting oxide layers against corrosion. Suitable metals include aluminum, titanium, vanadium, zirconium, hafnium, niobium, tantalum, tungsten and others.

In an embodiment, $TiO_2$ nanotubes with length of 4 μm, outer diameter of 110-120 nm and wall thickness of 40 nm can be fabricated directly in a microfluidic channel. Comparing to the distance between anode and cathode in conventional electrochemical anodization in bulk solutions (>5 cm), the current invention has a much smaller anode-to-cathode distance (e.g., 150-2050 μm), and thus provides a miniature device model to fabricate $TiO_2$ nanotubes.

Flow in the microfluidic channel significantly reduces the thickness of the oxide layer grown at the oxide-electrolyte interface during anodization. The growth of $TiO_2$ nanotubes was much faster in flow conditions in microfluidics than that of conventional methods. The length of $TiO_2$ nanotubes grown can be as high as ~4 μm during 30 min anodization at 40 V. In comparison, the length of $TiO_2$ nanotubes is 400 nm when there is no flow during the growth process in microfluidics and the length of $TiO_2$ nanotubes obtained from conventional electrochemical anodization in bulk is 6 μm for 19 hours anodization at 40 V.

The spatial distribution of the length of $TiO_2$ nanotubes fabricated in microfluidics can be controlled by adjusting the flow profile inside the channel. A parabolic flow profile parallel to the surface of the channel produces $TiO_2$ nanotubes with the largest length in the middle of the channel and short tubes at the edge of the channel.

$TiO_2$ nanotubes can grow on silicon surface with patterned arbitrary shapes including but not limited to a circle, triangle, and square shapes and letters.

The utility of the present disclosure includes but is not limited to the following uses: integrate $TiO_2$ nanotubes with silicon-based devices; integrate $TiO_2$ nanotubes with dye-sensitized solar cells; integrate $TiO_2$ nanotubes in flow for solar fuel production; and integrate $TiO_2$ nanotubes in flow for water purification.

This process can be implementing to any existing process for the generation of $TiO_2$ nanotubes. As a result, existing applications of $TiO_2$ nanotubes will apply to this invention. In particular, this process can be used to fabricate $TiO_2$ nanotubes on 1) silicon chips or CMOS; 2) portable or miniature devices for $TiO_2$-based energy production; and 3) $TiO_2$-based water purification devices.

The invention has been tested experimentally by fabrication of a microfluidic device using Ti-based channels. In an embodiment, the microfluidic device used to grow $TiO_2$ nanotubes through electrochemical anodization was composed of four parts: Ti substrate, polyacrylate film, Pt film, and polycarbonate from bottom to top. Ti served as the substrate for growing nanotubes; Pt as the cathode; polyacrylate as the isolating layer between cathode and anode; and polycarbonate served as the cover of microfluidic device.

The pattern of microchannel on Ti substrate was designed by using Solid Work software, and was then machined on the Ti substrate by a numeric controlled Bridgeport Vertical Milling machine equipped with Proto-TRAK system. Before milling, the Ti substrate were first polished and then cut into 9 pieces (1.18"×1.18"). Due to the high hardness of the Ti, the milling speed was set at 0.5 mm/min with a 0.2 inch endmill (TS-2-0200-S, PMT) at 3600 rpm for machining. The dimensions of the patterns of the microchannels were milled at 500 μm of the width and 2 mm of the depth.

For the purpose of separating the anode and cathode but enabling the contact between electrodes and electrolyte, either polyacrylate plastic or polyester film was used as an isolating layer depending on the purpose. Laser cutting technique was applied to cut the microchannel pattern and holes for screws on the polyacrylate plastic and polyester film.

The Pt film was cut into 0.5"×0.5" and embedded at the middle between the polycarbonate layer and isolating layer. A screw inserted through the polycarbonate from the top locating at the center was used to connect the Pt film with cathode electrode for electric conductivity.

The polycarbonate was cut into the size of 1.18"×1.18" and used as the top layer of microfluidic device. Four corner holes for assembling screws and one center hole for cathode connecting screw were drilled through the whole part and taped. Four smaller holes (0.06") served as inlets and outlets of fluids were drilled with good alignment with the Ti substrate pattern.

For microfluidic device fabrication, these four parts were assembled into an integrated microfluidic device by using four corner screws (#4-40, 0.089"). One additional screw (M3×0.5) was used to insert into the center polycarbonate part for connecting the cathode electrode with the Pt cathode embedded between polycarbonate and polyacrylate isolating layer. The anode electrode was connected with the screw located at the corner of device.

The present invention provides a process for the electrochemical anodization of titanium in an embodiment which enhances the anodic growth of $TiO_2$ nanotubes by decreasing the electrode distance at a constant anodizing voltage. According to an embodiment, the change of nanotube structures becomes more sensitive to the electrode distance at high anodizing voltages. The process provides a correlation between electrode distance and current density during the anodic growth of $TiO_2$ nanotubes to affect the growth of $TiO_2$ nanotubes. The process enables in situ growth of $TiO_2$ nanotubes in microdevices and offers a promising approach to produce $TiO_2$ nanotube arrays in a more energy-effective manner by just decreasing the electrode distance. By decreasing the electrode distance, both the diameter and length of $TiO_2$ nanotubes can be improved due to the enhanced steady-state current density.

A complex field-aided oxidation and dissolution process during electrochemical anodization of Ti is believed to be responsible for the formation of $TiO_2$ nanotube arrays. The oxidation of Ti in the anode produces $Ti^{4+}$ ions that migrate under the field and react with $O^{2-}$ ions to form the anodic $TiO_2$ layer. Fluorides ($F^-$) in the electrolyte, on the other hand, attack the $TiO_2$ layer and generate water soluble $TiF_6^{2-}$ ions, resulting in the dissolution of the $TiO_2$ layer and initiate the formation of $TiO_2$ nanotube arrays. Although the formation of tubular instead of porous $TiO_2$ layer is mechanistically debatable, $TiO_2$ nanotubes keep growing until the formation and dissolution of $TiO_2$ reaches equilibrium. At this stage, the thickness of the $TiO_2$ nanotube arrays, i.e., the length of $TiO_2$ nanotubes, keeps constant although $TiO_2$ nanotubes are penetrating deeper into the metal. Because the growth of $TiO_2$ nanotubes is controlled by the field-aided oxidation and $F^-$-based chemical dissolution, the diameter and length of $TiO_2$ nanotubes can be regulated by controlling the magnitude of applied electrical field, composition of the electrolyte (i.e., concentration of $F^-$, pH, and water content) and anodization time. The outer diameter of $TiO_2$ nanotubes, for example, increases linearly with applied voltage and long nanotubes are obtained with extended anodization.

Figure 11:
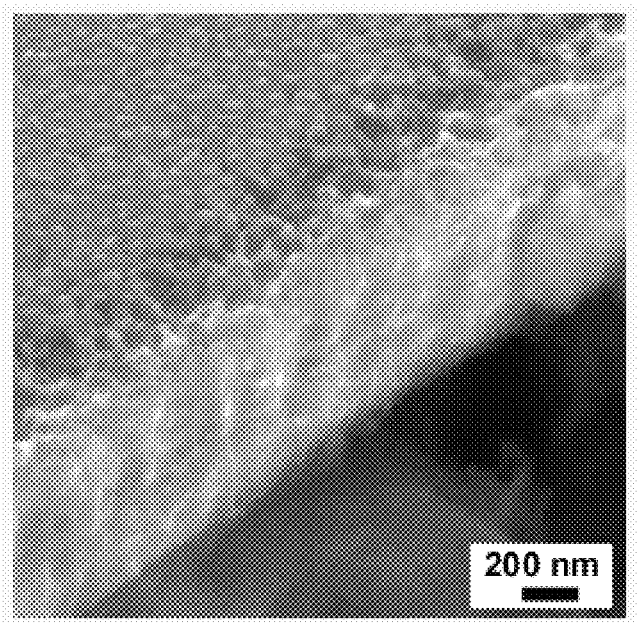
FIG. 11 is an SEM image of $TiO_2$ nanotubes.

In an embodiment microfluidic channels were fabricated directly inside a metallic Ti substrate and conducted electrochemical anodization of Ti to produce $TiO_2$ nanotube arrays under controlled flow conditions (FIGS. 1A, 1B, and 5A-5C and Table S1). The applied voltage (40V), composition of the electrolyte, and anodization time (30 min) were kept constant for all microfluidic experiments and only changed the hydrodynamic conditions in the microfluidic channel during anodization. FIG. 1C showed a typical scanning electron microscope (SEM) image of the Ti microfluidic channel covered with $TiO_2$ nanotube arrays after anodization. Consistent with previous studies, there was a compact oxide layer on the top of the nanotube arrays (FIG. 6A). With the increase of flow rates, however, the thickness and the coverage of the compact oxide layer initially formed at the electrolyte-oxide interface decreased significantly (FIGS. 1D, 1E and 6), implying that high flow rate inhibits the formation of the compact oxide layer during anodization. In addition, although the outer diameter of the nanotube did not change significantly with flow rates, the inner diameter of the nanotube increased with flow rates (FIGS. 1F, 1H, & 1I), resulting in a decrease of wall thickness of nanotubes. Remarkably, the length of nanotubes increased up to about 400% as the flow rate was increased from 0 μl/min to 200 μl/min (FIGS. 1G, 1J and 1K). It is important to note that the anodization time in the current microfluidic setup is 30 min whereas it takes approximately 8-10 hours to grow similar length of nanotubes in conventional static, bulk conditions. In addition, $TiO_2$ nanotubes produced under flow conditions have regular diameters with a narrow size distribution, suggesting that flow does not lead to inhomogeneous top structures as observed in most long-duration anodization experiments. Furthermore, when $TiO_2$ nanotubes were annealed at 425° C. and analyzed by X-ray diffraction (XRD), typical anatase $TiO_2$ reflection peaks A(101), A(004) and A(200) were observed and the magnitude of reflection peaks increased with flow rates (FIG. 1L). In particular, comparing to nanotubes with similar length but produced under conventional static, bulk conditions, $TiO_2$ nanotubes generated at high flow rates (e.g., 200 μl/min) showed significantly increased peak intensity of A(004) and $I_{004}/I_{200}$ (FIGS. 1L and 1M), implying that the crystal growth of $TiO_2$ nanotubes produced at flow conditions is preferentially oriented along the [001] direction. The current-time characteristics of anodization under flow conditions were examined (FIG. 2A). Current-time curves particularly at high flow rates, i.e., 200 μl/min, showed typical patterns of growing $TiO_2$ nanotubes, which included an exponential decrease of the current due to the formation of the oxide layer (stage I), followed by a slight increase of current due to the formation of initial porous structures (stage II), and then a relatively steady current due to the formation of self-organized nanotube arrays (stage III). The magnitude of the steady state current at stage III correlates to the thickness of nanotube arrays and will not increase significantly with extended anodization time unless the anodic potential is changed. Without the change of applied voltage, however, the steady state current changed with flow rates and increased linearly with Peclet number (Pe) (FIG. 2B and Table S2). Pe is defined as the ratio of the rate of convection by the flow to the rate of diffusion driven by a concentration gradient (Pe=Lu/D, where L is the characteristic length, u is the flow velocity, and D is the diffusion coefficient) and high Pe indicates a convection-dominated mass transport process. Because the length of nanotubes correlated inversely with the steady state current (FIG. 2C), the increased steady state current with Pe suggests that convection perpendicular to nanotubes plays a role in the regulation of key transport processes that are important to the growth of $TiO_2$ nanotubes. Previous studies of anodization of Ti in static conditions showed that there were concentration gradients of $F^-$ and $TiF_6^{2-}$ ions inside and outside the nanotubes and a diffusion layer was presenting adjacent to the top of the nanotubes. When flow is applied tangentially to the surface of nanotube arrays, the thickness of the diffusion layer, Ldiff, which can be estimated as $2\sqrt{Dt}$ or $2\sqrt{D}\ L/\mu$ decreases with the increase of flow velocity u and becomes negligible at high flow velocity or Pe. In this case, convection dominates the mass transport on the top of nanotubes and local concentration of $TiF_6^{2-}$ will approach to zero and $F^-$ concentration will be close to the bulk $F^-$ concentration in the electrolyte (FIG. 2D). The change of local concentrations of $TiF_6^{2-}$ and $F^-$ on the top of nanotubes modifies the boundary conditions of ions transport inside the nanotubes where concentration gradients of $F^-$ and $TiF_6^{2-}$ ions still exist. As a result, the ion-flux rates in the nanotubes are enhanced (Table S3), resulting in an increased anodization current density with flow rates (FIG. 2A). $TiF_6^{2-}$ is the diffusion rate controlling species in the formation of nanotubes, effective removal of $TiF_6^{2-}$ accelerates the dissolution kinetics at the bottom of the nanotube arrays, and thus produces long nanotubes at high Pe (FIGS. 1G and 1K). The increased concentration of $F^-$ on the top of nanotubes, on the other hand, facilitates the chemical etching of the top nanotubes, leading to large inner diameters as shown in FIG. 11. In addition, the flow-induced change of ion transport modifies the local electrical field during anodization and consequently the degree of preferred crystal orientation after annealing. To further demonstrate the effect of flow on the growth of $TiO_2$ nanotubes, the diameter and length of nanotubes was measured across the microfluidic channel perpendicular to the flow direction (FIG. 3A). Because the flow was pressure-driven and the height of the channel in the z direction was larger than the width of the channel in the x direction, the flow velocity profile became parabolic in the x-y plane with the highest flow velocity in the middle of the channel. As a result, nanotubes in the middle of the channel were expected to have the largest inner diameter and length. Experimental results particularly obtained at high flow rates were consistent with the prediction (FIGS. 3B and 3C). When the height of the channel was reduced while keeping the width of channel unchanged, the parabolic flow profile switched from the x-y plane to the y-z plane and left a relatively uniform velocity distribution in the x-y plane (FIG. 3F). In this case, nanotubes with relatively uniform inner diameter and length across the channel were obtained (FIGS. 3G and 3H). Pe or flow velocity was kept approximately the same in both devices at high flow rates (Tables S4 and S2). Similar results were obtained at upstream and downstream in both devices (FIGS. 8 and 9). Results show that both the nanotube structure (length and diameter) and the spatial distribution of nanotube structure can be controlled by manipulating the magnitude and distribution of flow velocity during anodization. Suitable flow rates include flow rates sufficient to inhibit growth of an oxide layer on the nanotubes while maintain laminar flow of the electrolyte solution. Suitable flow rates include Pe numbers within a laminar flow regime above about 100 and above about 1000.

Figure 4A:
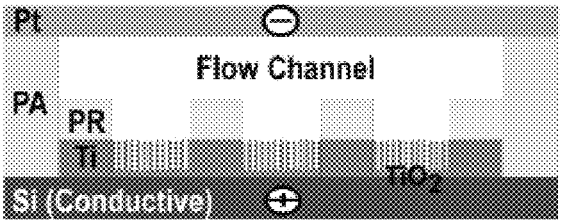
FIGS. 4A-4H illustrates control of the growth of $TiO_2$ nanotubes on silicon substrates.
Figure 4B:
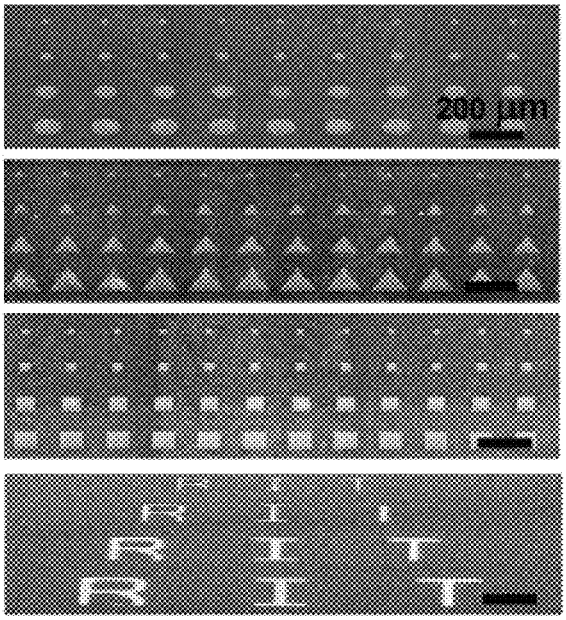
Figure 4C:
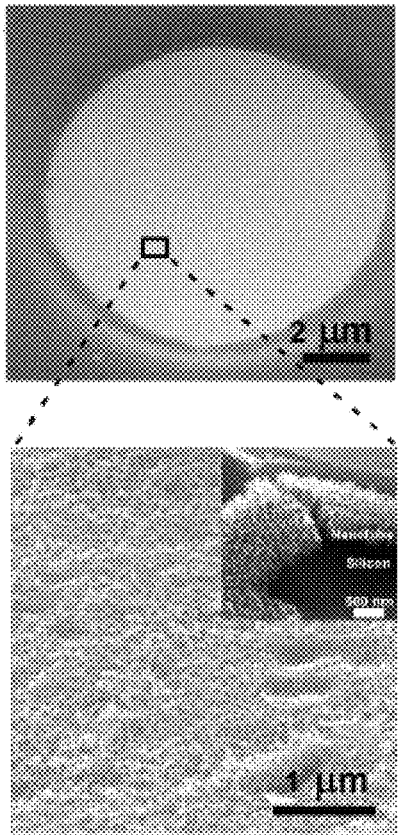

Moreover, when metallic Ti thin-film with a thickness of 500 nm was deposited on a conductive silicon substrate ($\Omega=1-5\times10^{-3}$ Ohm-cm) and patterned photolithographically inside a microfluidic channel (FIG. 4A), $TiO_2$ nanotubes could grow uniformly inside the patterned areas (FIGS. 4B and 4C). High resolution SEM images showed that nanotubes grew vertically in the patterned areas and had average diameter and length of 78±5.4 nm and 304±12.3 nm respectively (FIG. 4C). $TiO_2$ nanotubes were grown microfluidically using Ti thin-film (1 μm thick) deposited on a non-conductive silicon substrate ($\Omega=1-2\times10^4$ Ohm-cm) (FIGS. 4D and 4E), horizontally aligned nanotubes were produced inside the walls of the channel after anodization (FIG. 4E top inset) while vertically aligned nanotubes were presented in the channel (FIG. 4E bottom inset). Similar phenomena were observed when a photolithographically patterned Ti layer and Ti layers with reduced thickness were used (FIG. 10). The inner diameter and density of horizontally aligned nanotubes increased with flow rates (FIGS. 4F and 4G). Horizontally aligned nanotubes were not observed on a Ti layer that was deposited on conductive silicon substrates (FIG. 11).

Because the growth of $TiO_2$ nanotubes follows the direction of the electrical field during anodization, the appearance of horizontally aligned nanotubes suggests that the direction of electrical field switched to the horizontal direction during anodization. Such change is possible when a Ti layer is deposited on a non-conductive silicon substrate. In this case, when nanotubes grow throughout the entire Ti layer and reach the non-conductive silicon substrate, the electrical field in the vertical direction will change to the horizontal direction due to the presence of non-conductive silicon substrate at the bottom and the conductive Ti in the side walls (FIG. 4H). Meanwhile, the growth of $TiO_2$ nanotubes uses the contact of Ti walls with the electrolyte solution so that field-aided reaction can penetrate into the Ti side walls to form nanotubes. This Ti-electrolyte interaction is also likely at late stages of anodization considering the continuous chemical etching on the top nanotubes and the finite thickness of the Ti layer. Indeed, at the end of anodization, the length of nanotubes inside the channel (376±16.4 nm) was much smaller than the thickness of the original Ti layer (1 μm) deposited on the silicon substrate (FIG. 12) and horizontally aligned nanotubes were not presenting at the early stage of anodization (5 min) (FIG. 13). The results demonstrate that by controlling the direction of the applied electrical field and the contact of Ti-electrolyte solution during anodization, $TiO_2$ nanotube arrays can be produced with desired orientations.

The regulatory roles of flow in the anodic growth of $TiO_2$ nanotube arrays in microfluidics showed that both the structural and material features of $TiO_2$ nanotubes and the spatial distribution of such features could be controlled by manipulating the magnitude and distribution of flow velocity during anodization. The growth of $TiO_2$ nanotubes was much faster in flow conditions and took approximately 56% of the time required to grow similar length of $TiO_2$ nanotubes in conventional static conditions. Furthermore, by depositing Ti on silicon substrates, both vertically and horizontally aligned $TiO_2$ nanotubes could be produced through microfluidics, and thus provided a powerful approach to construct hierarchical nanotube arrays on silicon-based materials. The microfluidic approaches offer a useful platform to effectively grow $TiO_2$ nanotubes in controlled flow conditions and suggest strategies to integrate silicon with $TiO_2$ nanotubes that may find applications in nanoelectronics, solar cells, sensors and photocatalytic devices.

An embodiment of the fabrication and assembly of a microfluidic device are shown in FIG. 1. The microchannel on a Ti substrate (2 mm thick, 99.2% pure, Alfa Aesar, Ward Mill, Mass.) was fabricated using a Bridgeport Vertical Milling machine equipped with Proto-TRAK system. The width and height of the Ti channel were 500 μm and 50 μm, respectively. When the Ti channel was assembled for anodization, the overall height of the microfluidic channel, which was also the approximate anode-to-cathode distance, was 150 μm or 2050 μm, depending on the thickness of the electrical isolation layer, i.e., the PA film. During anodization, an electrolyte solution containing 15 wt % $NH_4F$ (Sigma Aldrich), 3 ml DI water, and 145 ml ethylene glycol (VWR) was injected into the microfluidic device at different flow rates, 0, 1, 10, 100, or 200 μl/min, using a syringe pump (Harvard Apparatus PhD2000). The electrochemical anodization was conducted at 40 V using an electric power supply (TKD-Lambda) for 0.5 hour at room temperature (25° C.) for all microfluidic experiments. To produce $TiO_2$ nanotubes in conventional static, bulk conditions, Ti film (0.5 mm thick, 99.2% pure, Alfa Aesar, Ward Mill, Mass.) and Pt film (0.025 mm thick, 99.9% pure, Alfa Aesar, Ward Mill, Mass.) were submerged under the electrolyte solution with a distance of 1 cm. The anodization was conducted at 60V for 30 min at room temperature (25° C.). The length of $TiO_2$ nanotubes produced under conventional static, bulk conditions have a length of 3.7±0.16 μm, which is similar to the length of nanotubes produced at the flow rate of 200 μl/min in microfluidics. The synthesized $TiO_2$ nanotubes were annealed at 425° C. for 1 h in air using a Dual Zone Split Tube Furnace (OTF-1200X).

To grow $TiO_2$ nanotubes on silicon substrates, a Ti thin-film was deposited on a 3" silicon wafer (University Wafer) by using a SC4500 a-beam evaporator. For patterned geometries, the thickness of Ti thin-film was 500 nm and SU2001 photoresist (MicroChem) was spanned on the Ti thin-film via a Brewer CEE6000 automated spin coater at 3000 rpm to obtain a photoresist thickness of 1 μm. The silicon wafer was doped with Boron and exhibited low electrical resistivity ($\Omega=1-5\times10^{-3}$ Ohm-cm). The wafer was baked at 95° C. before lithography. A quartz mask with different dimensions of circular, triangle and square shapes and logo of RIT was fabricated by using Heidelberg mask writer DWL2000. The wafer was then exposed to LTV light under the mask in an ABM contact mask aligner and developed to obtain the desired pattern on Ti. The silicon wafer with Ti coating was served as the bottom part of the assembled microfluidic device and used to grow $TiO_2$ nanotubes. The width and height of the microfluidic channel used to grow $TiO_2$ nanotubes in patterned areas were 1 mm and 2 mm, respectively. The flow rate was 20 μl/min. To grow horizontally aligned $TiO_2$ nanotubes, pure silicon with high electrical resistivity ($\Omega=1-2\times10^4$ Ohm-cm) was used and Ti thin-film with a thickness of 500 nm or 1 μm was deposited on the silicon wafer as described above. The width and height of the microfluidic channel were 1 mm and 2 mm, respectively. The flow rate was 0, 1, 10, 100, or 200 μl/min. The Reynolds number for all the experiments varied from $9\times10^{-3}$ to 1.9. Suitable laminar flow includes a Reynolds number of less than about 2000.

A scanning electron microscope (FIB-SEM, Zeiss Cross Beam) was used to image the $TiO_2$ nanotubes. Nanotubes were etched with HCl (37%, Sigma Aldrich) for 2-5 min and cleaned with acetone before imaging. Energy Dispersive X-ray Spectroscopy (EDS) was conducted to analyze the presence of Ti and oxygen elements in the nanotubes. X-ray diffraction (XRD) was conducted with a Philips X'Pert MRD diffractometer (Spectris plc) using a long-fine-focus Cu Ka radiation source at 40 kV and 30 mA. The scanning range of 2θ was set from 20° to 50° with a 0.03° step size. The crystalline structures of $TiO_2$ nanotubes were identified by comparison and analysis with FIZ/NIST Inorganic Crystal Structure Database.

Figure 1B:
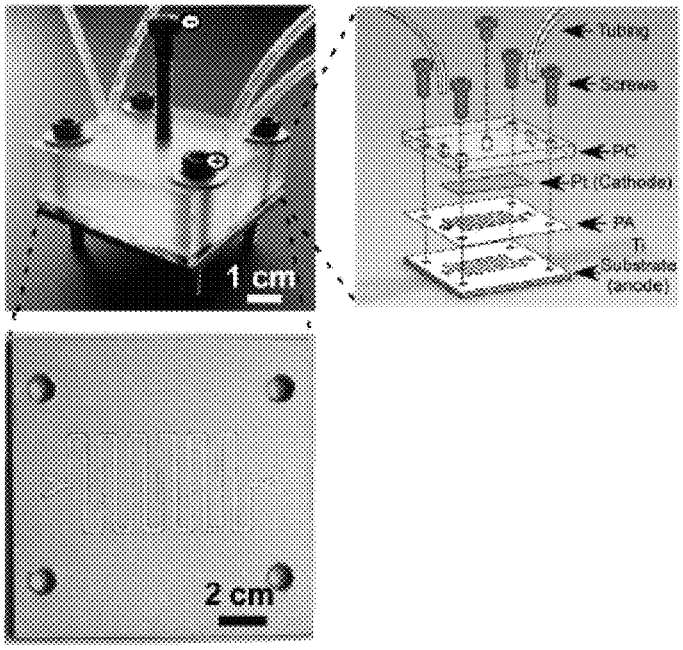
Figure 1C:
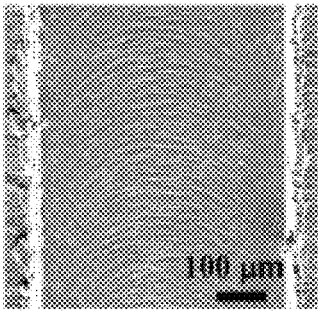
Figure 1D:
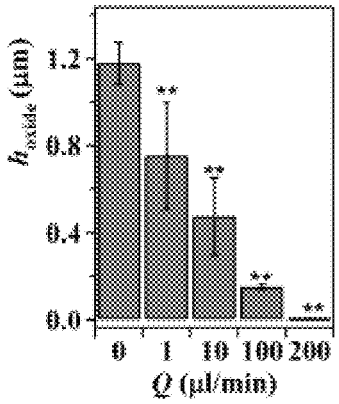
Figure 1E:
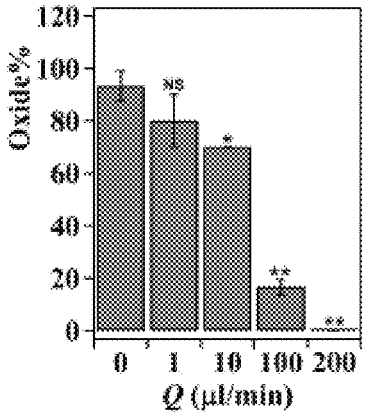
Figure 1F:
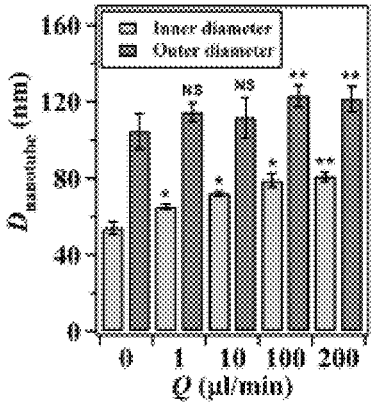
Figure 1G:
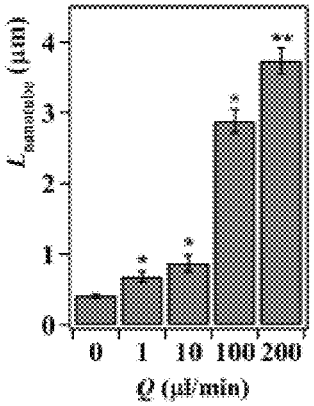
Figure 1H:
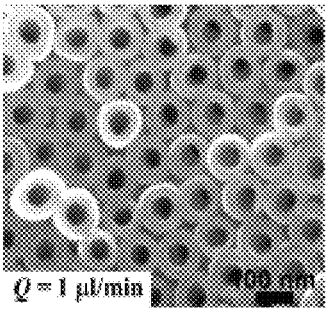
Figure 1I:
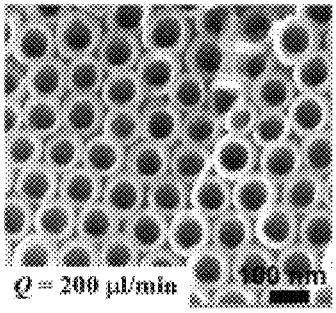
Figure 1J:
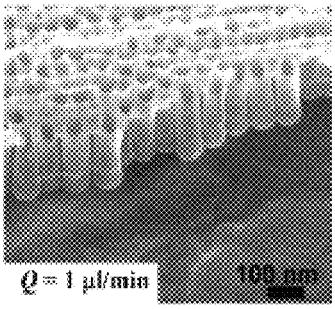
Figure 1K:
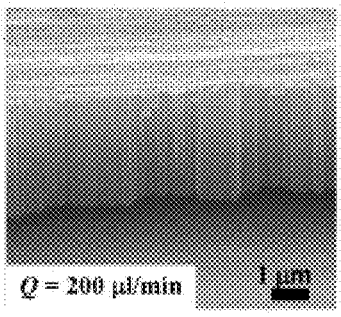
Figure 1L:
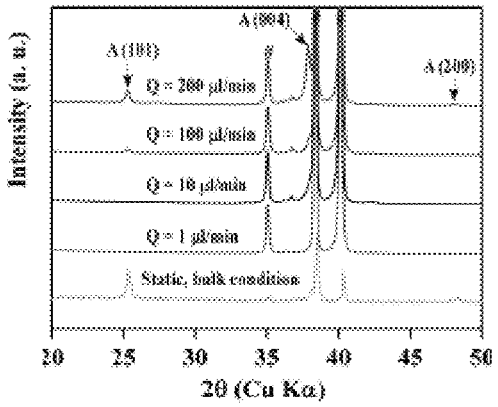
Figure 1M:
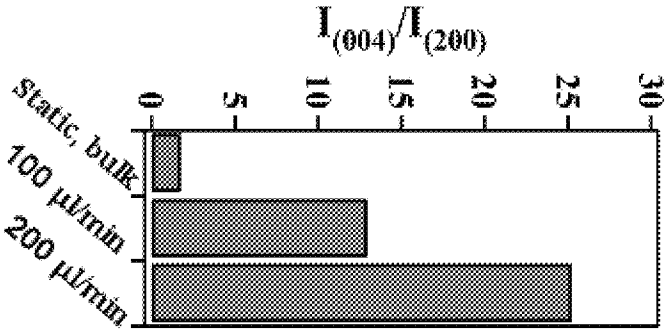
Figure 2A:
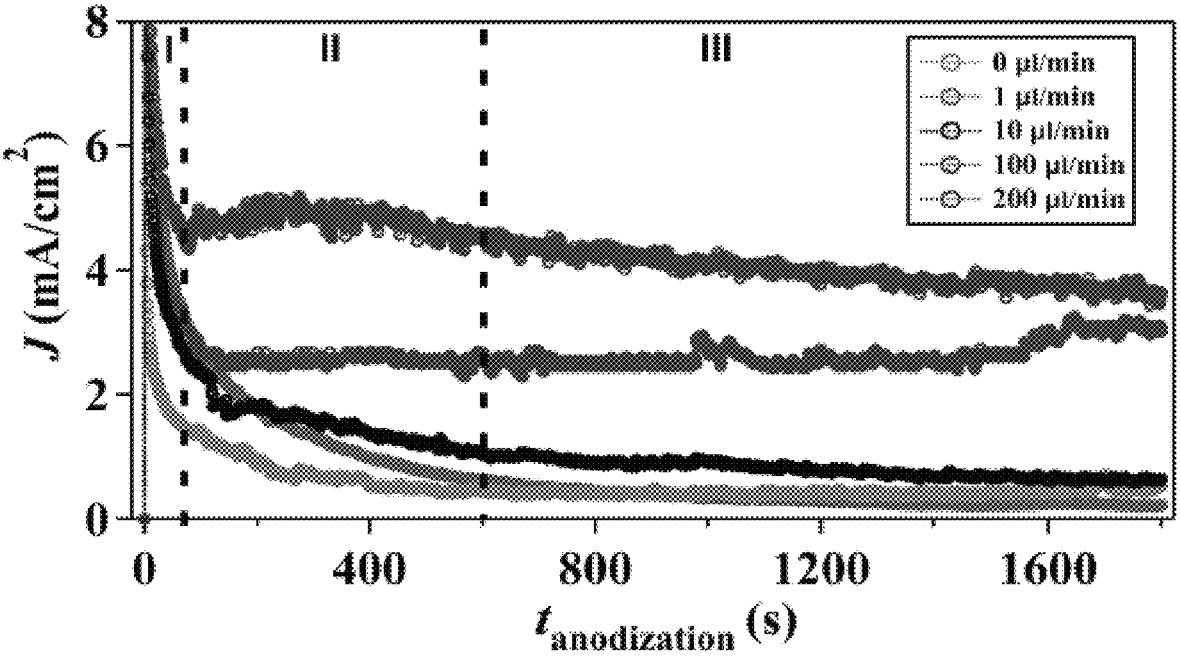
FIGS. 2A-2D illustrates the effect of flow on the current density during anodization.
Figure 2B:
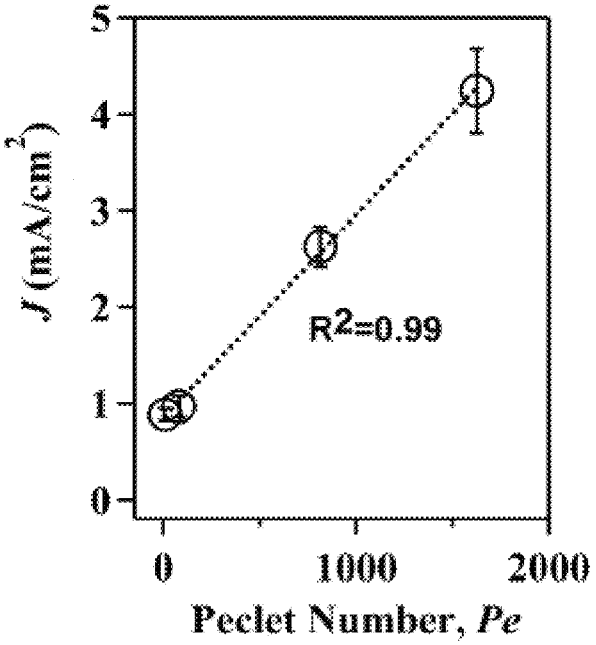

FIGS. 1A-1K illustrates the effect of flow on the growth of $TiO_2$ nanotubes in microfluidics. FIG. 1A is a schematic of the generation of $TiO_2$ nanotubes via electrochemical anodization under flow conditions. FIG. 1B shows a bright-field image of an embodiment of an assembled microfluidic device. The schematic image (right insert) shows the microfluidic device that is assembled by a titanium (Ti) substrate, a polyacrylate (PA) film, a Pt foil, and a block of polycarbonate (PC). The PA film acts as an isolating layer between the cathode (Pt) and the anode (Ti). The PC block serves as the cover of the microfluidic device. Four screws inserted through the corners of the PC block to the Ti substrate act as the anode electrodes. An additional screw that is inserted at the center of the device and connects the Pt foil serves as the cathode electrode. The enlarged image (below insert) shows the microfluidic channel fabricated on Ti by micromachining. The width and height of the channel are 500 μm and 50 μm, respectively. FIG. 1C is a representative SEM image of a $TiO_2$ nanotube-covered microfluidic channel prepared with a flow rate of 200 μl/min. FIG. 1D is a graph of the change of thickness of the oxide layer with flow rates. FIG. 1E is a graph of the percentage of the oxide coverage at different flow rates in the microfluidic channel. FIG. 1F is a graph of the effect of flow rates on the inner and outer diameters of $TiO_2$ nanotubes. FIG. 1G is a graph of the effect of flow rates on the length of $TiO_2$ nanotubes. FIGS. 1H & 1I are SEM images of a top view of $TiO_2$ nanotubes fabricated at the flow rate of 1 μl/min and 200 μl/min, respectively. FIGS. 1J & 1K are SEM images of a side view of $TiO_2$ nanotubes fabricated at the flow rate of 1 μl/min and 200 μl/min, respectively. FIG. 1L shows XRD patterns of annealed $TiO_2$ nanotubes generated at different flow rates and in static, bulk condition. Note that nanotubes generated at static conditions have a similar length as that produced at Q=200 μl/min. Reflection peaks from Ti are labelled by #. FIG. 1M is a graph of the intensity ratio $I_{004}/I_{200}$ of $TiO_2$ nanotubes generated at different conditions. $TiO_2$ nanotubes produced at high flow rates showed preference crystal orientation (004) after annealing at 425° C.

Figure 2C:
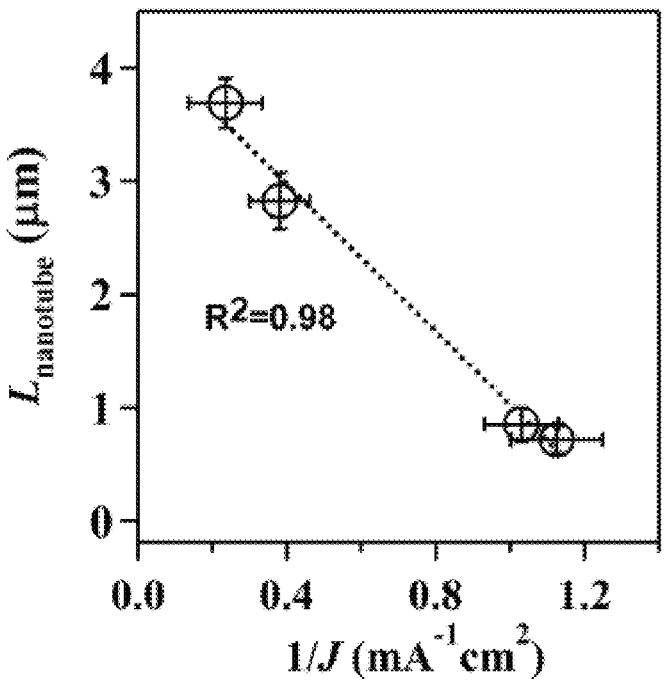
Figure 2D:
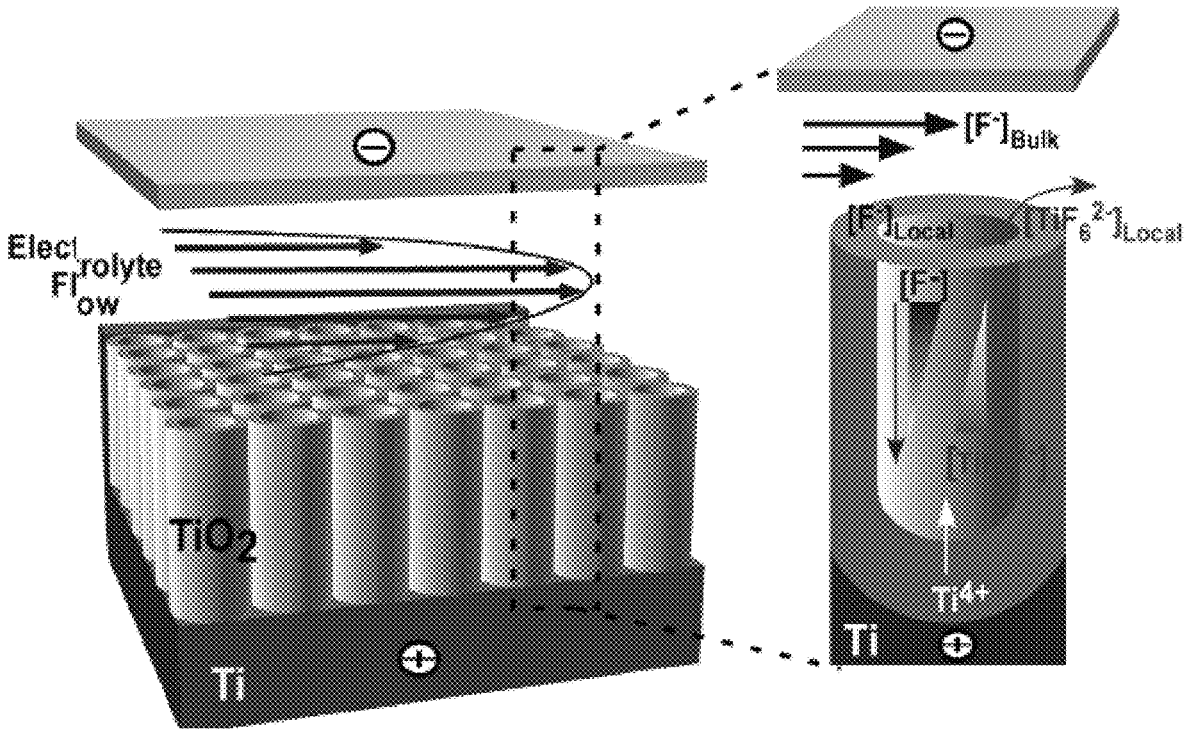
Figure 3A:
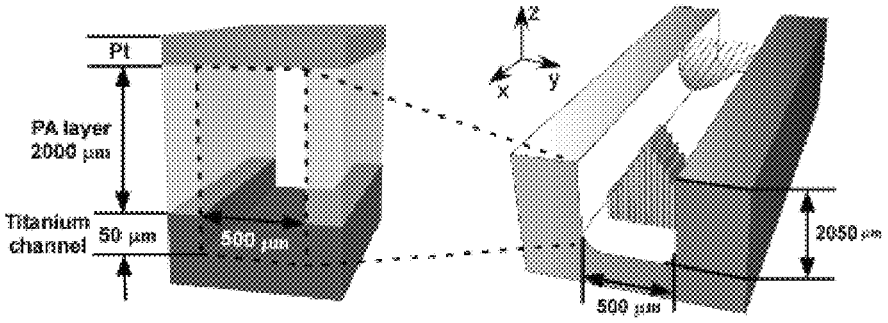
FIGS. 3A-3J illustrates the effect of flow on the spatial growth of $TiO_2$ nanotubes in microfluidics.
Figure 3B:
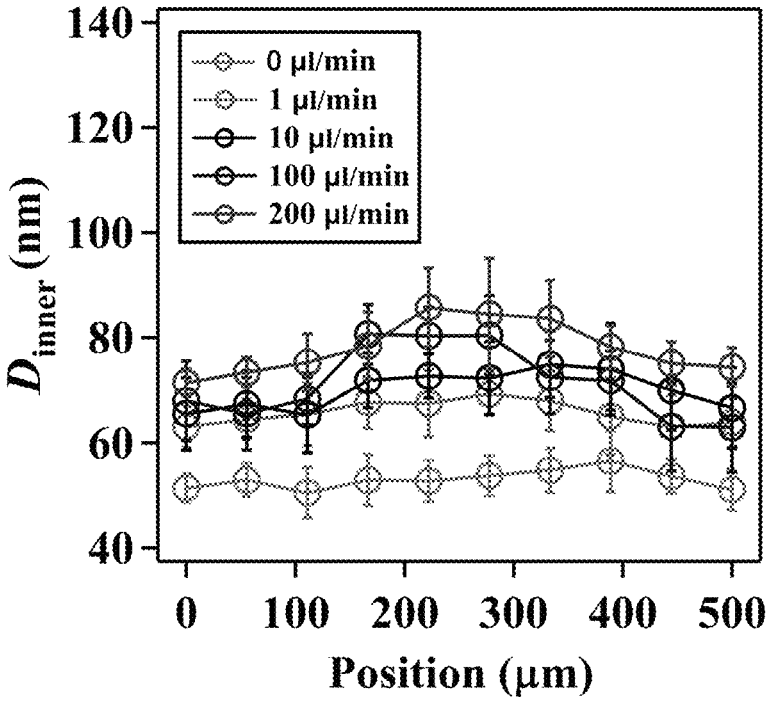
Figure 3C:
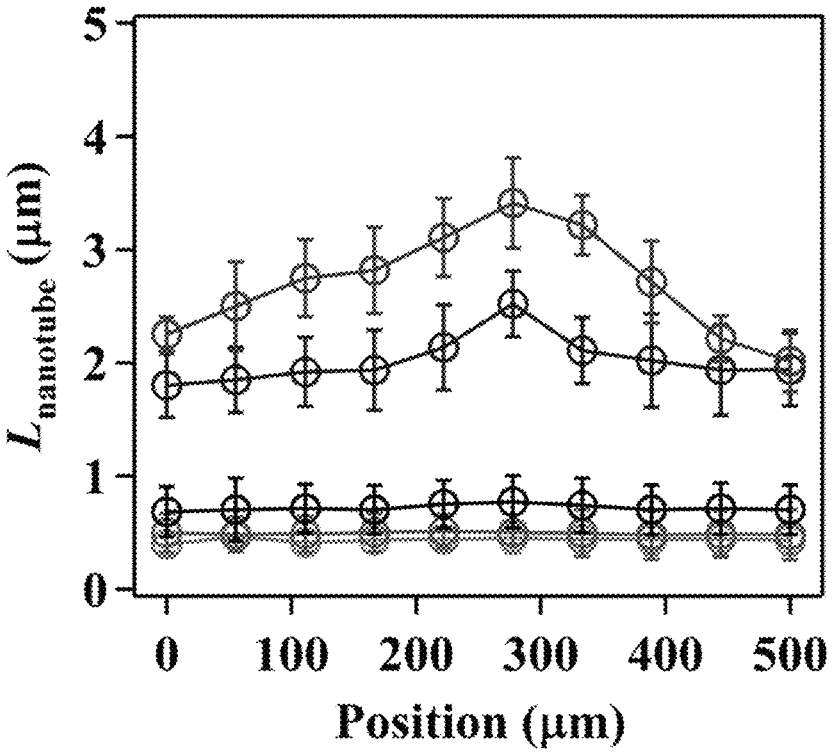
Figure 3D:
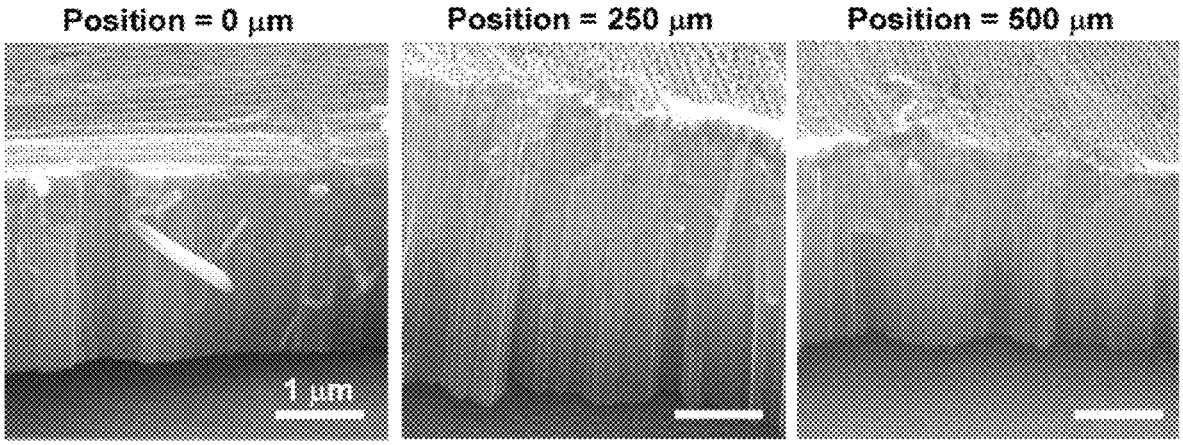
Figure 3E:
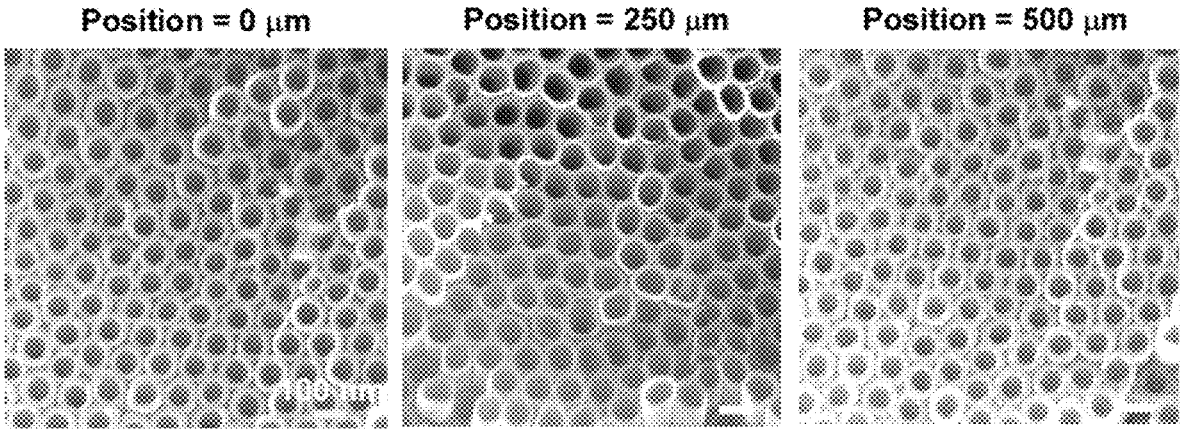
Figure 3F:
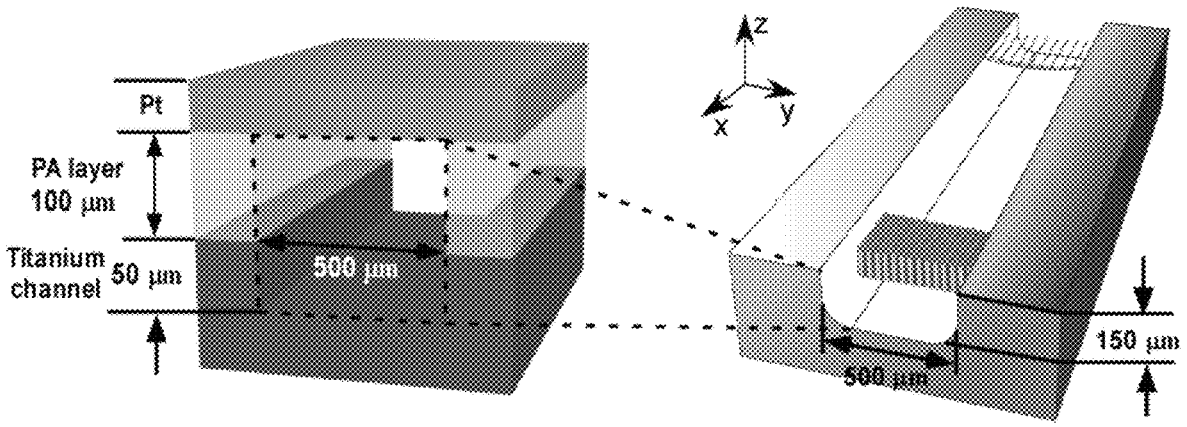
Figure 3G:
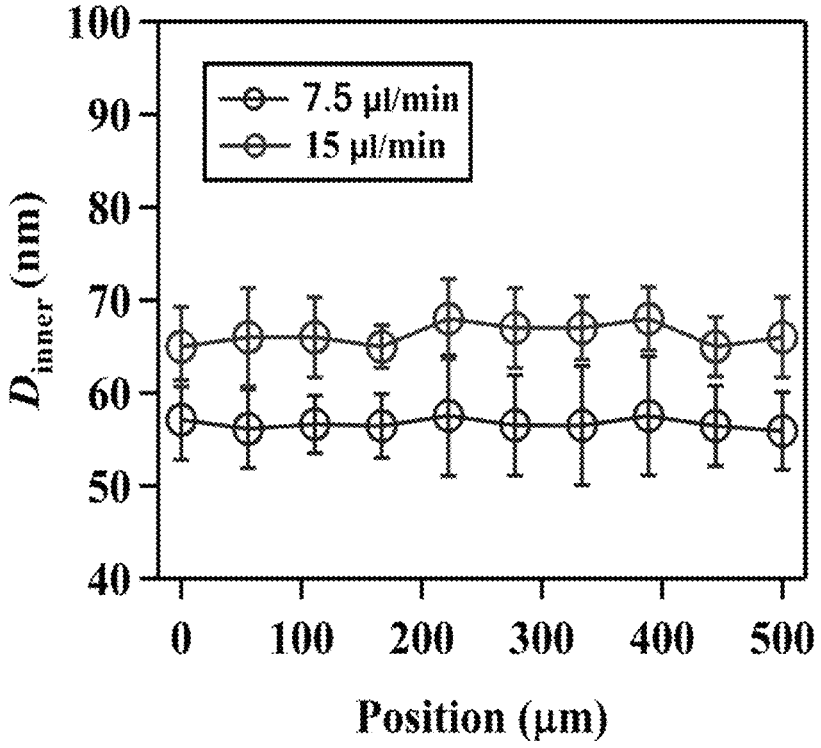
Figure 3H:
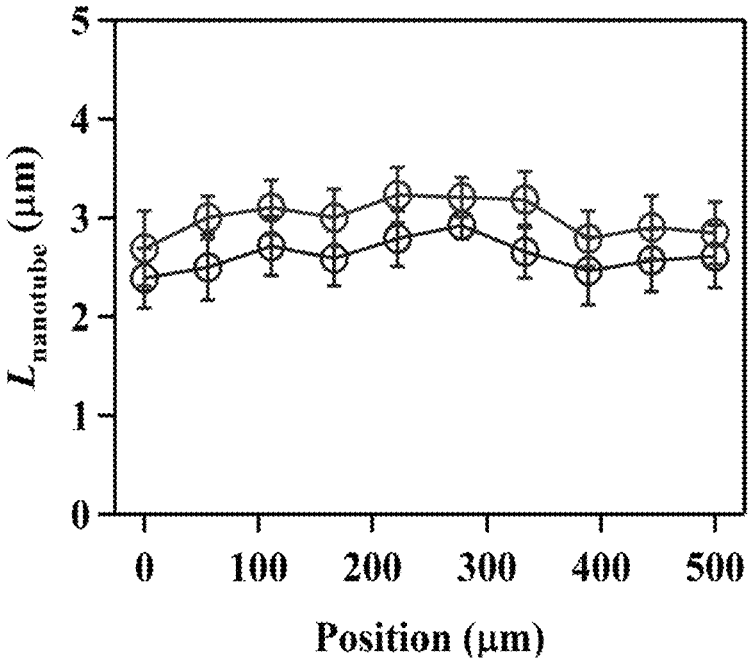
Figure 3I:
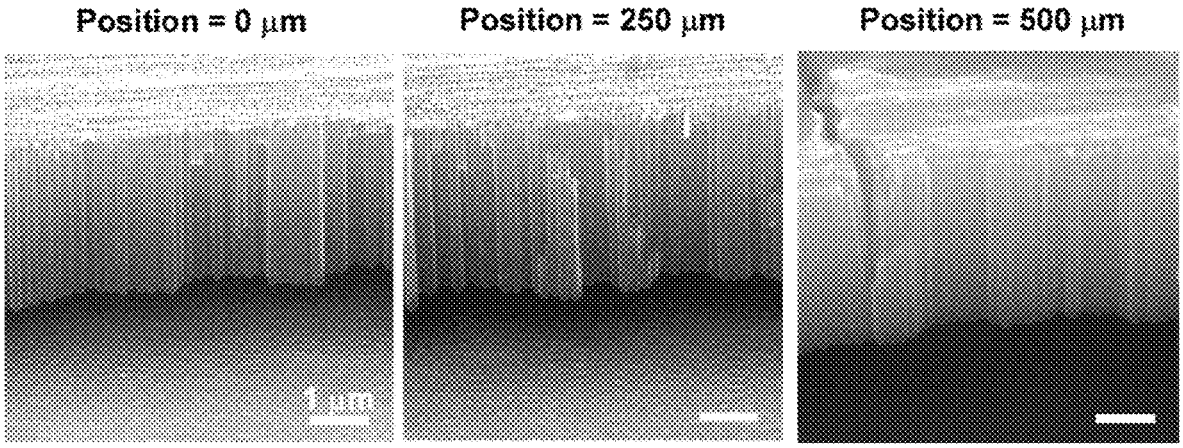
Figure 3J:
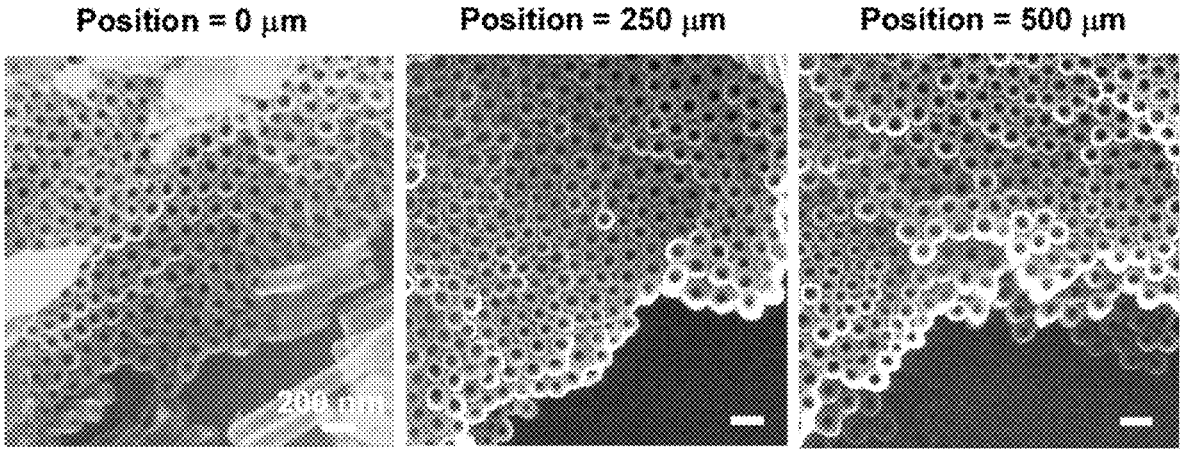

FIGS. 2A-2D illustrates the effect of flow on the current density during anodization. FIG. 2A shows current-time curves during the growth of $TiO_2$ nanotubes at different flow rates. I, II, and III indicate different growth stages. The steady state current at stage III correlates to the length of nanotubes. FIG. 2B indicates steady current density at stage III increases linearly with Peclet number (Pe=Lu/l), where L is the width of the channel, u is the velocity of the fluid, and D is the diffusion coefficient). The dotted line is a linear regression fitting curve with a correlation coefficient of 0.99. FIG. 2C indicates the length of $TiO_2$ nanotubes correlates reciprocally with the average steady current density. The dotted line is a linear regression fitting curve with a correlation coefficient of 0.98. FIG. 2D illustrates the schematics of the regulatory roles of flow in the growth of $TiO_2$ nanotubes. Flow at high Pe reduces the thickness of the diffusion layer on the top of the nanotubes and thus modifies boundary conditions, i.e., $[F^-]_{Local} \approx [F^-]_{Bulk}$ and $[TiF_6^{2-}]_{Local} \approx 0$, resulting in an enhanced ion flux inside the nanotube.

FIGS. 3A-3J illustrates the effect of flow on the spatial growth of $TiO_2$ nanotubes in microfluidics. FIG. 3A shows the schematics of the cross-sectional view of a microfluidic channel with a width of 500 um and a height of 2050 um. The height of channel is much larger than the width of channel, the velocity profile of the flow is thus parabolic in the x-y plane. As a result, nanotubes with large inner diameter (FIG. 3E) and length (FIG. 3D) in the center of channel are expected. The change of inner diameter, shown in FIG. 3B, and length, shown in FIG. 3C, of $TiO_2$ nanotubes, respectively, across the width of the channel at different flow rates in the microfluidic device shown in FIG. 3A. FIG. 3F shows the schematics of the cross-sectional view of a microfluidic channel with a width of 500 um and a height of 150 um. In this case, the height of channel is smaller than the width of channel, the velocity profile of the flow is parabolic in the y-z plane but flat in the x-y plane, and thus nanotubes with relatively uniform diameter (FIG. 3J) and length (FIG. 3I) across the channel width are expected. The change of inner diameter, shown in FIG. 3G, and length, shown in FIG. 3H, of $TiO_2$ nanotubes, respectively, across the width of a channel at flow rates of 7.5 μl/min and 15 μl/min in the microfluidic device shown in FIG. 3F. Flow rates of 7.5 μl/min and 15 μl/min in the device shown in FIG. 3F provide similar flow velocity and Pe as the flow rates of 100 μl/min and 200 μl/min in the device shown in FIG. 3A, respectively. See Tables S2 and S4.

TABLE S1

EDS analysis of element composition of the Ti area and $Ti0_2$ nanotubes in microfluidics

| Element | At. No. | Line s. (KeV) | Mass [%] | Mass Norm. [%] | Atom [%] |
|---|---|---|---|---|---|
| Ti area | | | | | |
| Oxygen | 8 | K-Serie: 0.5249 | 16.90 | 14.13 | 32.99 |
| Titanium | 22 | L-Serie: 0.4522 | 102.70 | 85.87 | 67.01 |
| $TiO_2$ area | | | | | |
| Oxygen | 8 | K-Serie: 0.5249 | 46.50 | 34.99 | 61.69 |
| Titanium | 1.1 | L-Serie: 0.4522 | 86.40 | 65.01 | 38.31 |

TABLE S2

Calculation of Pe in the microfluidic device with a height of 2050 μm

| | Flow rate Q (μl/min) | | | |
|---|---|---|---|---|
| | 1 | 10 | 100 | 200 |
| Width of channel L (μm) | 500 | | | |
| Height of channel H (μm) | 2050 | | | |
| Cross-section area A ($m^2$) | $1.03 \times 10^{-6}$ | | | |
| Average velocity U = Q/A (m/s) | $1.62 \times 10^{-5}$ | $1.62 \times 10^{-4}$ | $1.62 \times 10^{-3}$ | $3.24 \times 10^{-3}$ |
| Diffusivity D ($m^2$/s) | $1 \times 10^{-9}$ | | | |
| Pe = UL/D | 8.1 | 81 | 810 | 1620 |

TABLE S3

Calculation of diffusion flux inside the $TiO_2$ nanotubes

| | Static | Flow |
|---|---|---|
| $[TiF_6^{2-}]$ at the bottom of nanotubes $C_b$(M) | $1.4 \times 10^{-4}$ | $1.4 \times 10^{-4}$ |
| $[TiF_6^{2-}]$ at the top of nanotubes $C_o$(M) | $5 \times 10^{-5}$ | 0 |
| Length of nanotubes dx (μm) | 4 | 4 |
| Diffusivity D ($m^2$/s) | $1 \times 10^{-9}$ | |
| Diffusion flux J (mole/$m^2 \cdot s$) | $2.25 \times 10^{-5}$ | $3.5 \times 10^{-5}$ |
| % increase of J in flow ($J_{flow}$-$J_{static}$/$J_{static}$) | 56% | |

TABLE S4

Calculation of Pe in the microfluidic device with a height of 150 um

| | Flow rate Q (μl/min) | |
|---|---|---|
| | 7.5 | 15 |
| Width of channel L (μm) | 500 | |
| Height of channel H (μm) | 150 | |
| Cross-section area A ($m^2$) | $7.5 \times 10^{-8}$ | |
| Average velocity U = Q/A (m/s) | $1.62 \times 10^{-3}$ | $3.34 \times 10^{-3}$ |
| Diffusivity D ($m^2$/s) | $1 \times 10^{-9}$ | |
| Pe = UL/D | 835 | 1670 |

Figure 4D:
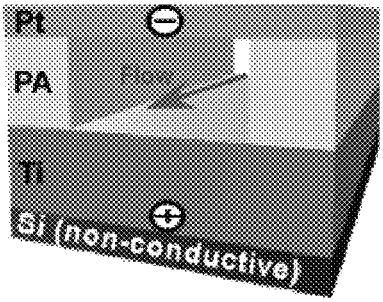
Figure 4E:
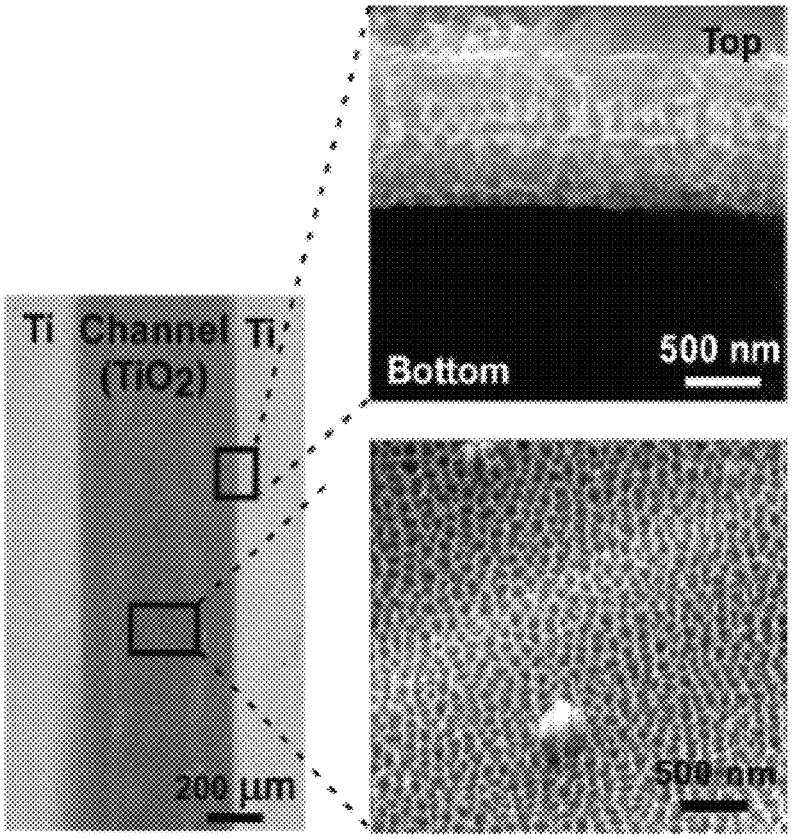
Figure 4F:
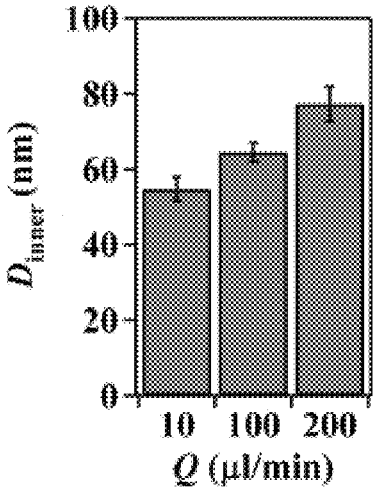
Figure 4G:
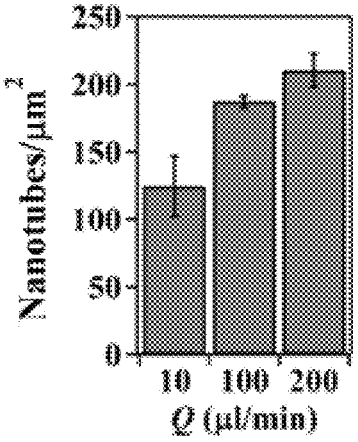
Figure 4H:
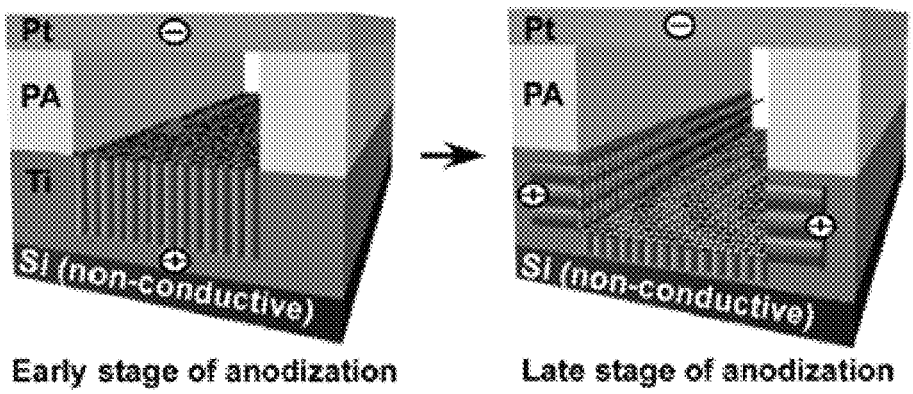

FIGS. 4A-4H illustrates control of the growth of $TiO_2$ nanotubes on silicon substrates. FIG. 4A a schematic of the growth of $TiO_2$ nanotubes on a conductive silicon substrate ($\Omega$=1–5×$10^{-3}$ Ohm-cm) with photoligraphically patterned goemetries. FIG. 4B is a series of SEM images of $TiO_2$ nanotubes grown in patterned circle, triangle, square and logo of "RIT", respectively, with a flow rate of 20 μl/min. FIG. 4C are high resolution SEM images of $TiO_2$ nanotubes grown in patterned circular shape. Images below show the top view and side view (inset) of $TiO_2$ nanotubes inside the circular pattern. FIG. 4D is a schematic of growth of $TiO_2$ nanotubes on a non-conductive silicon substrate ($\Omega$=1–2×$10^4$ Ohm-cm) in a microfluidic channel. FIG. 4E is a representative SEM image of growing $TiO_2$ nanotubes on a nonconductive silicon substrate. The dark area indicates the channel where anodization occurs. The gray areas show Ti coated on silicon where no anodization occurs. Flow rate: 200 μl/min. The upper inset is an SEM image of the edge of the channel where Ti in the wall was anodized to produce horizontally oriented $TiO_2$ nanotubes. The lower inset is an SEM image of $TiO_2$ nanotubes growing in the center of the microfluidic channel. FIGS. 4F & 4G show the change of inner diameter of horizontally oriented $TiO_2$ nanotubes and the number of nanotubes per area inside the side wall of the channel, respectively. FIG. 4H is a schematic of the growing mechanism of horizontally aligned $TiO_2$ nanotubes on a non-conductive silicon substrate. The change of the direction of the electrical field and exposure of Ti side walls to the electrolyte flow at late stages of anodization are likely responsible for the observed horizontally-aligned $TiO_2$ nanotubes.

Figure 5A:
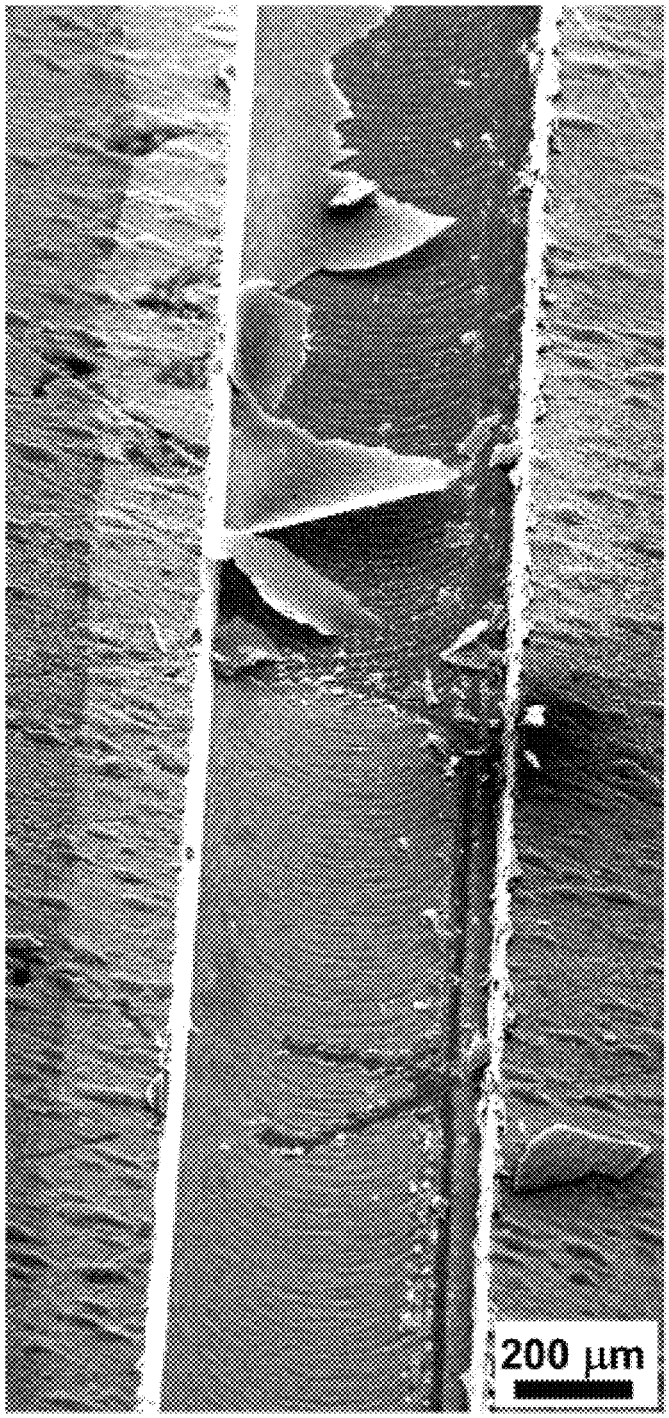
FIGS. 5A-5C show the characterization of $TiO_2$ nanotubes using energy dispersive X-ray spectroscopy (EDS)
Figure 5B:
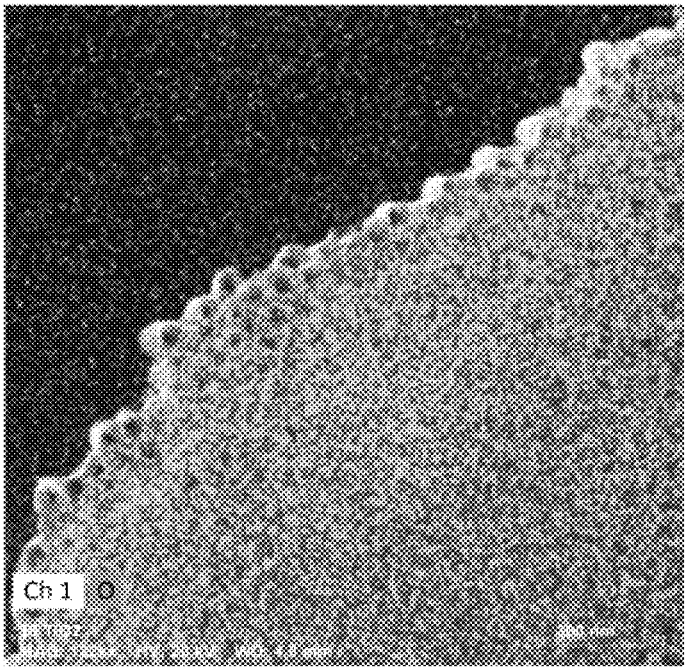
Figure 5C:
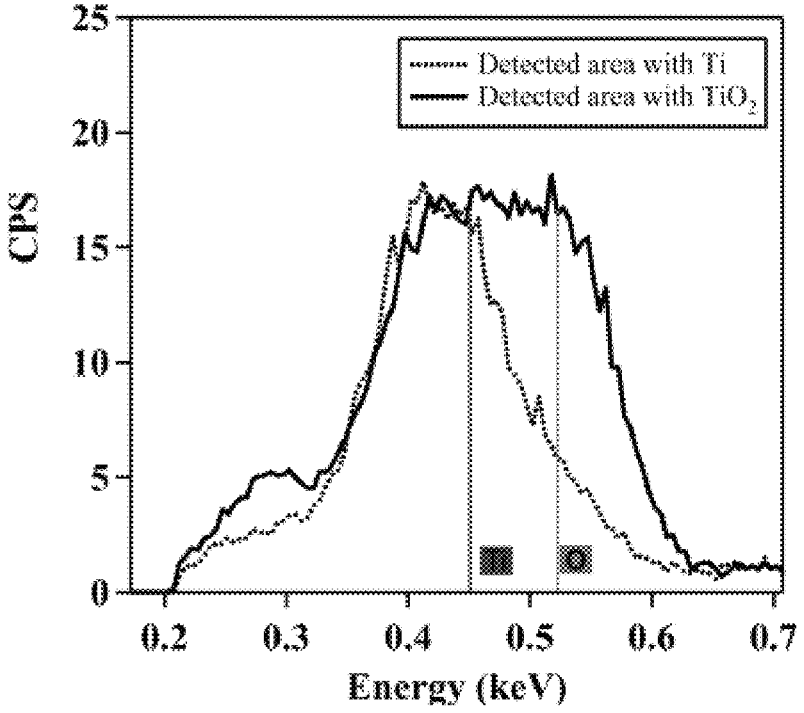
Figure 6A:
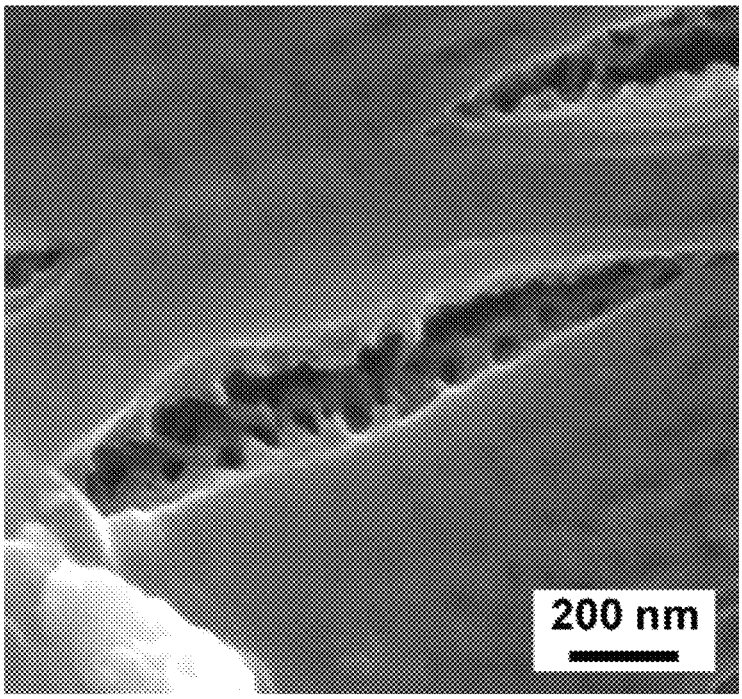
FIGS. 6A-6B show the effect of flow on the growth of the oxide layer formed at the oxide-electrolyte interface.

FIGS. 5A-5C show the characterization of $TiO_2$ nanotubes using energy dispersive X-ray spectroscopy (EDS). FIG. 5A is an SEM image of $TiO_2$ nanotube-covered microfluidic channel. The layer of $TiO_2$ nanotubes was mechanically scratched to expose the underneath Ti substrate. FIG. 5B is an SEM image of the EDS analysis in selected areas of the $TiO_2$ nanotube-covered microfluidic channel. Green color represents oxygen element in the sample. FIG. 5C is a graph of intensity of Ti and O element at different energy levels. The Ti/O ratio is estimated to be 1:2 from the ratio of the peak height of O (0.452 keV) and Ti (0.523 keV).

Figure 6B:
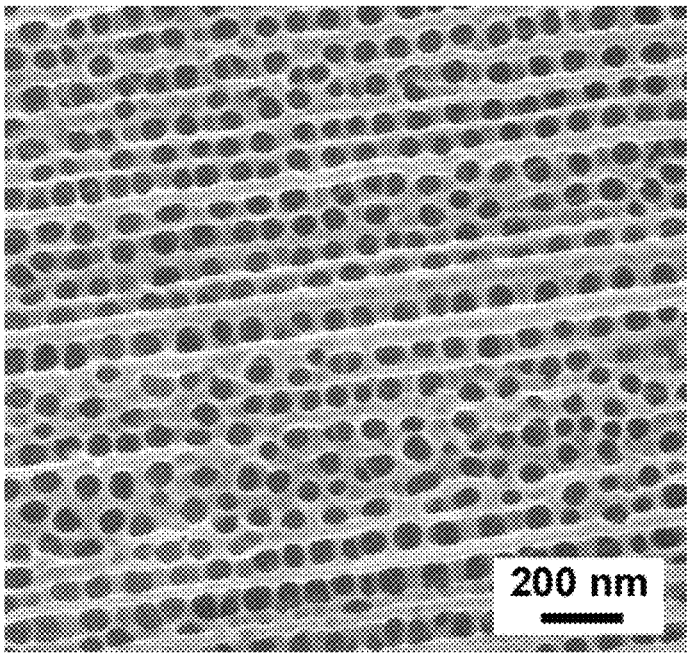

FIGS. 6A and 6B show the effect of flow on the growth of the oxide layer formed at the oxide-electrolyte interface. FIGS. 6A & 6B show the typical SEM images of the oxide layer formed under a flow rate of 1 μl/min and 200 μl/min, respectively.

Figure 7A:
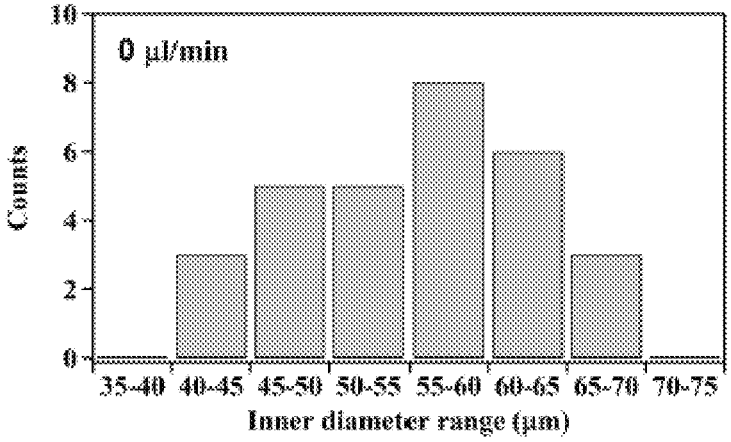
FIGS. 7A, 7B, 7C, 7D, and 7E are graphs of flow rate verses inner diameter.
Figure 7B:
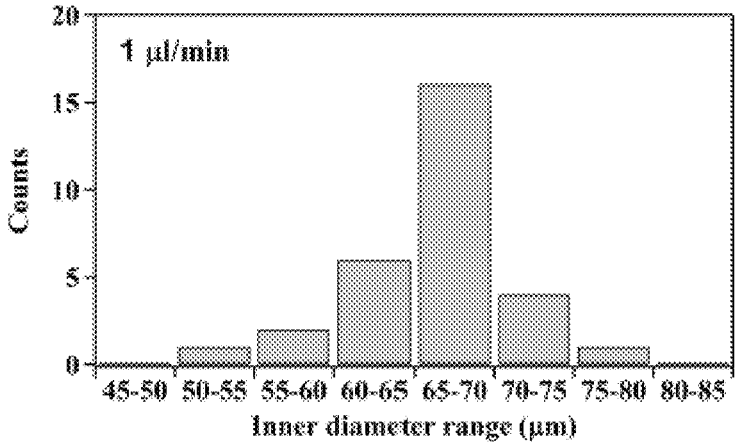
Figure 7C:
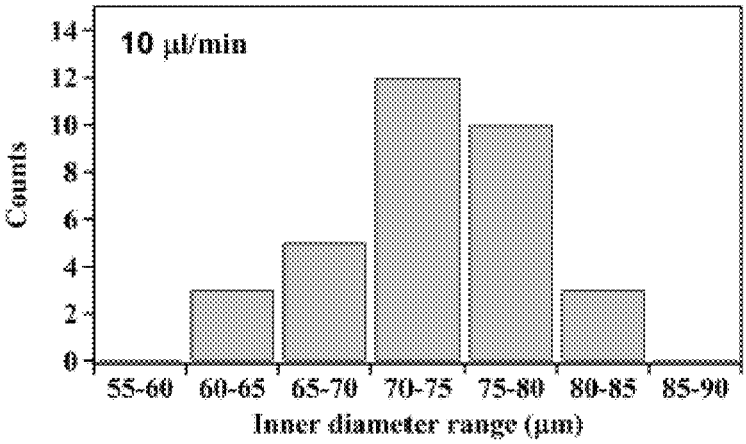
Figure 7D:
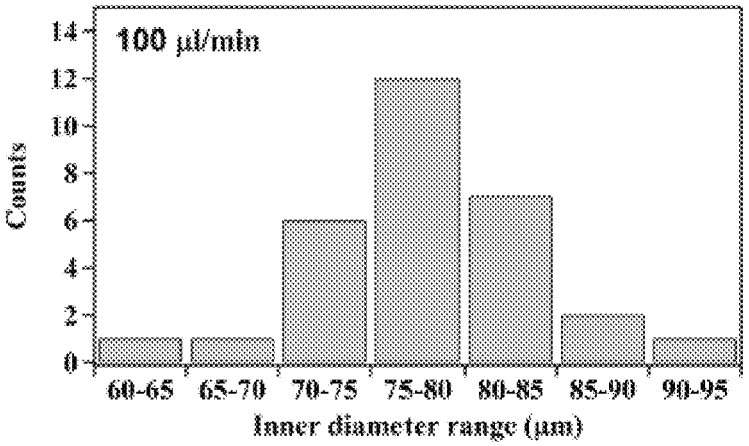
Figure 7E:
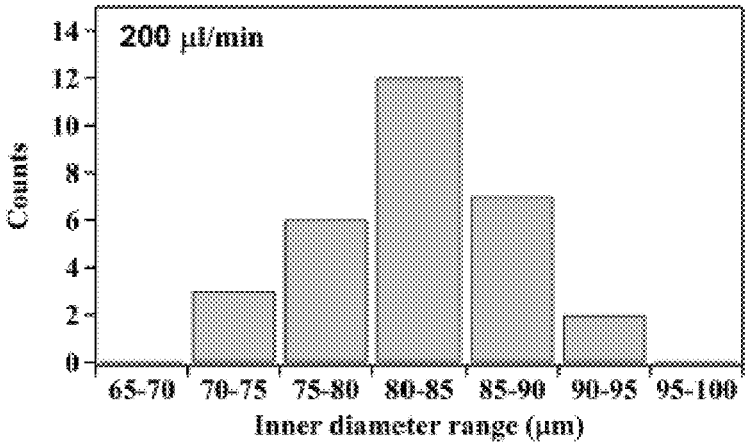

FIGS. 7A (0 μl/min), 7B (1 μl/min), 7C (10 μl/min), 7D (100 μl/min) and 7E (200 μl/min) are graphs of flow rate verses inner diameter of $TiO_2$ nanotubes produced through anodization in a microfluidic device.

FIGS. 8A-8C shows the effect of flow on the spatial growth of $TiO_2$ nanotubes in microfluidics at different locations along the microfluidic channel. FIG. 8A is a schematic of the microchannel. Arrows indicate the flow direction. The change of length FIG. 8B upstream and FIG. 8C downstream across the width of microchannel fabricated at different flow rates, as indicated. The width and height of the channel are 500 μm and 2050 μm, respectively.

FIGS. 9A-9C shows the effect of flow on the spatial growth of $TiO_2$ nanotubes in microfluidics at different locations along the microfluidic channel. FIG. 9A is a schematic of the microchannel. Arrows indicate the flow direction. The change of length at FIG. 9B upstream and FIG. 9C downstream across the width of microchannel fabricated at flow rates of 7.5 μl/min and 15 μl/min. The width and height of the channel are 500 μm and 150 μm, respectively.

Figure 10A:
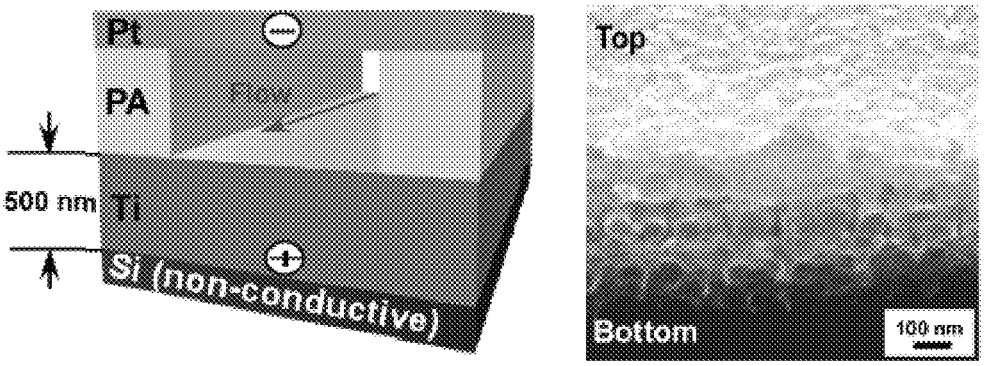
FIGS. 10A-10C shows the horizontal growth of $TiO_2$ nanotubes on non-conductive silicon substrates.
Figure 10B:
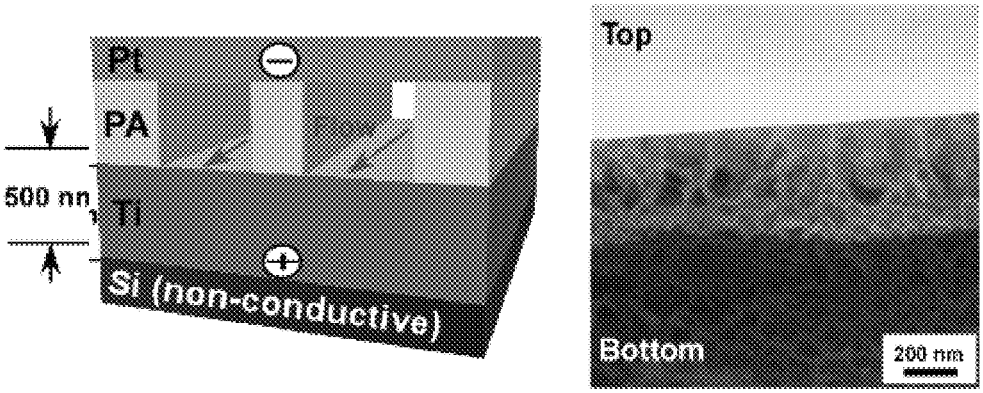
Figure 10C:
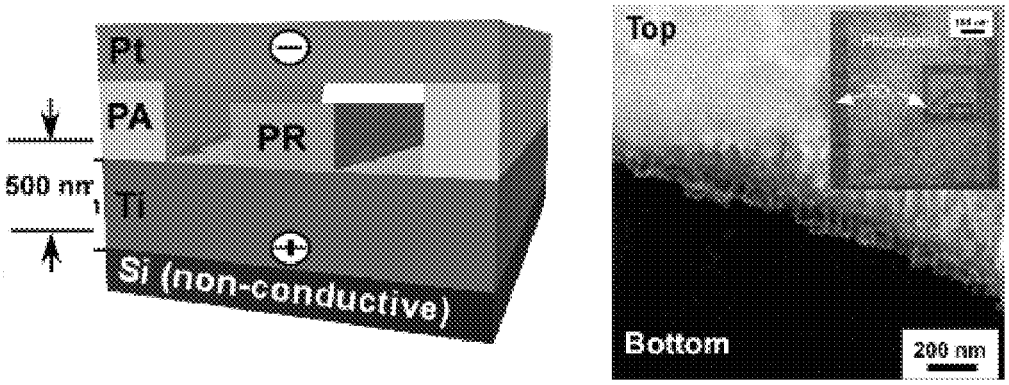

FIGS. 10A-10C shows the horizontal growth of $TiO_2$ nanotubes on non-conductive silicon substrates. FIG. 10A shows the growth of $TiO_2$ nanotubes using a single microfluidic channel. The thickness of Ti coating is 500 nm. The width and the height of channel are 1 mm and 2 mm, respectively. Flow rate: 200 μl/min. FIG. 10B shows the growth of $TiO_2$ nanotubes using a double microfluidic channel. The thickness of Ti coating is 500 nm. The width and the height of the channel are 1 mm and 2 mm, respectively. The distance between channels is 1 mm. Flow rate: 200 μl/min. FIG. 10C shows the growth of $TiO_2$ nanotubes on SPR 220 3.0 photoresist patterned surfaces using a single microfluidic channel. The width and the height of the channel are 1 mm and 2 mm, respectively. The thickness of the SU-8 pattern is 3 μm. Inset: dark area was Ti layer that was exposed to flow to produce $TiO_2$ nanotubes.

FIG. 11 is an SEM image of $TiO_2$ nanotubes grown on a conductive silicon substrate. The SEM image shows the microfluidic channel wall when anodization of Ti was conducted on a conductive silicon substrate for 30 min.

Figure 12A:
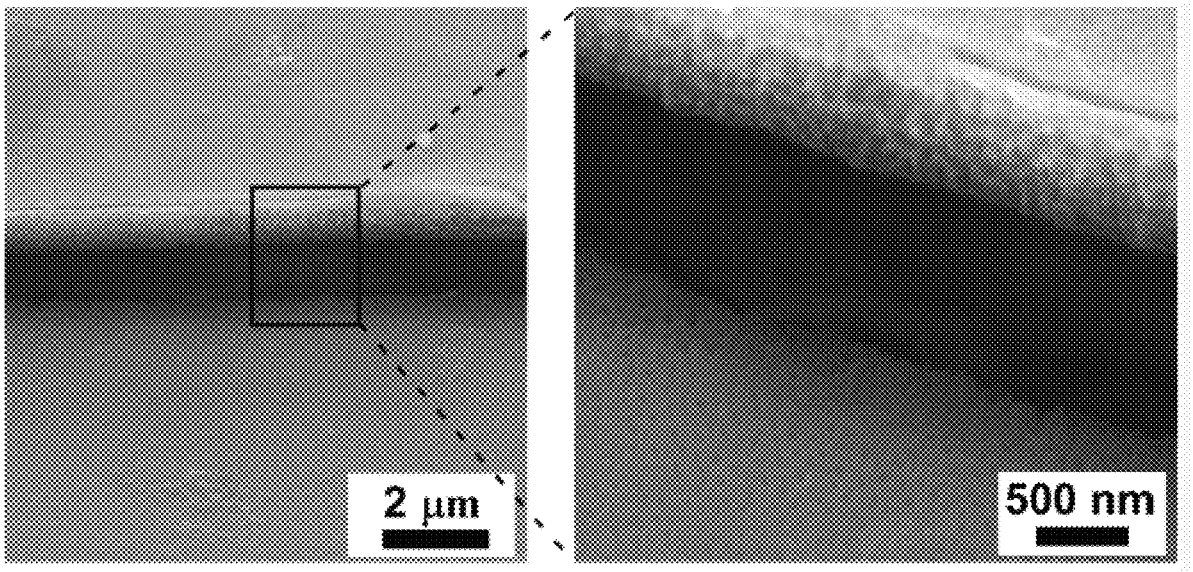
FIGS. 12A-12B show $TiO_2$ nanotubes growing on a non-conductive silicon substrate.
Figure 12B:
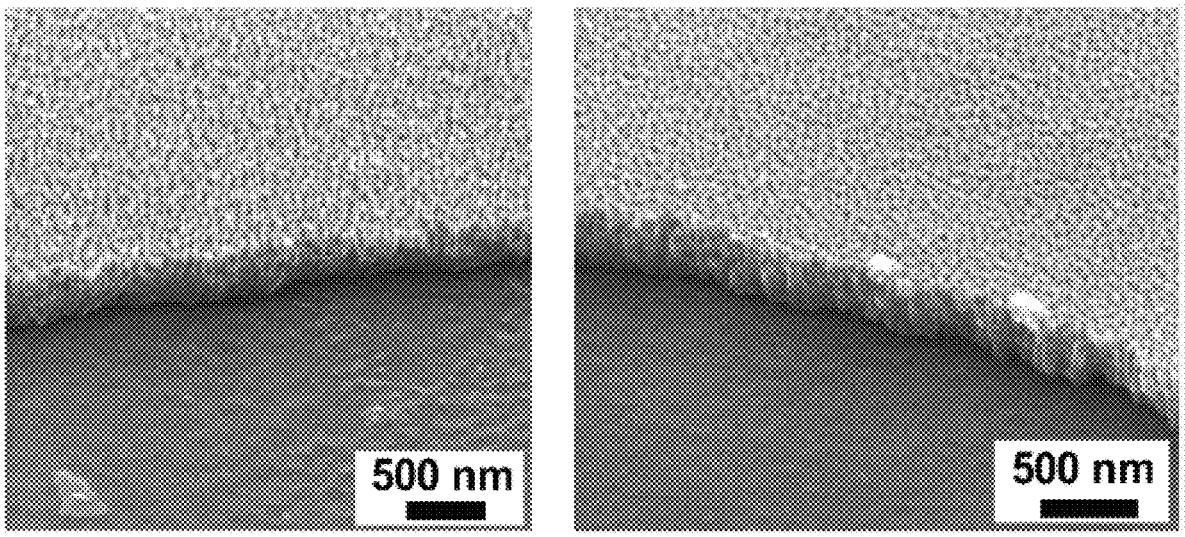
Figure 13:
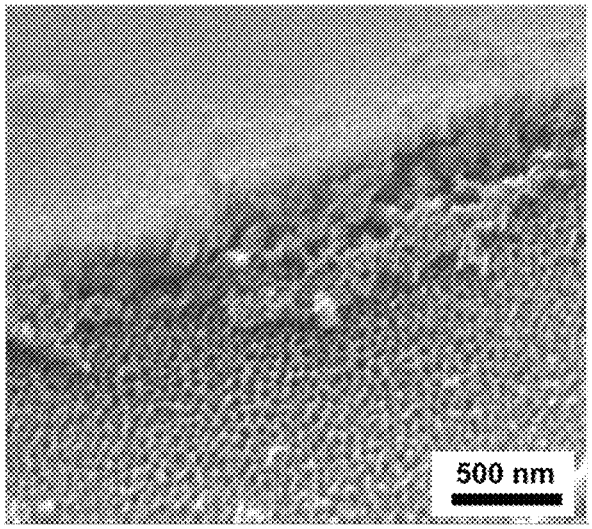
FIG. 13 shows an SEM image.

FIGS. 12A-12B show $TiO_2$ nanotubes growing on a non-conductive silicon substrate. SEM images in FIG. 12A show the exposure of sidewalls of microfluidic channel at the end of anodization. FIG. 12B show SEM images of $TiO_2$ nanotubes in the center of the microchannel with a much shorter length (376+16.4 nm) comparing to the original thickness (1 μm) of the Ti film.

FIG. 13 shows early stage of the growth of $TiO_2$ nanotubes on a non-conductive silicon substrate. The SEM image shows the nanotubes only grow vertically at the center of the microfluidic channel and no horizontal growth of nanotubes in the side walls are observed at the anodization time of 5 min.

FIGS. 14A-14C illustrate electrode distance regulates the anodic growth of $TiO_2$ nanotube. FIG. 14A shows a schematics of the anodic growth of $TiO_2$ nanotubes. The anodizing voltage (V) is kept at 20, 40 or 60V. The distance between the cathode (Pt) and anode (Ti) (d) varies at 5, 1, 0.2, or 0.05 cm for each anodizing voltage. SEM images of FIG. 14B top view and FIG. 14C side view of $TiO_2$ nanotubes fabricated at 60V when the electrode distance is controlled at 5, 1, 0.2, or 0.05 cm.

Figure 15A:
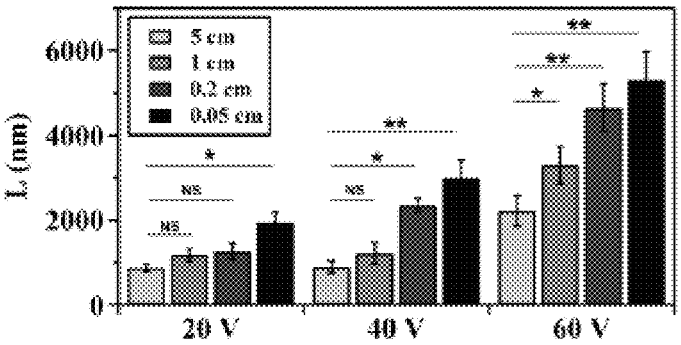
FIGS. 15A-C show the effect of electrode distance (d) on the growth of $TiO_2$ nanotubes at different anodizing voltages.
Figure 15B:
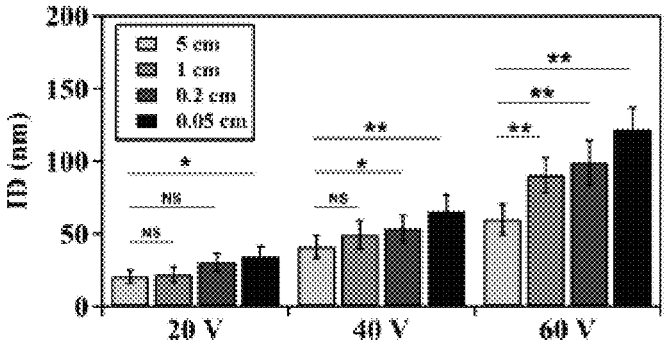
Figure 15C:
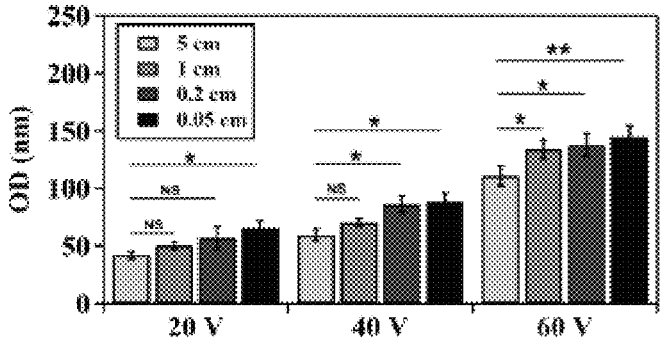

FIGS. 15A-C show the effect of electrode distance (d) on the growth of $TiO_2$ nanotubes at different anodizing voltages. The dependence of FIG. 15A length (L), FIG. 15B inner diameter (ID) and FIG. 15C outer diameter (OD) of $TiO_2$ nanotubes on d at an anodizing voltage of 20, 40 or 60V. $^{**}P<0.01$, $^{*}P<0.05$, and non-significant (NS) were calculated based on paired t-test analysis.

Figure 16A:
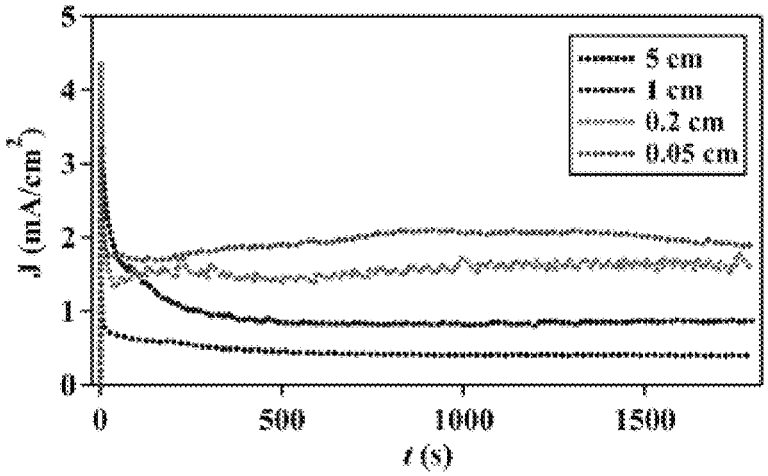
FIGS. 16A-16B show electrode distance (d) regulates current density (J) during the anodic growth of $TiO_2$ nanotubes.
Figure 16B:
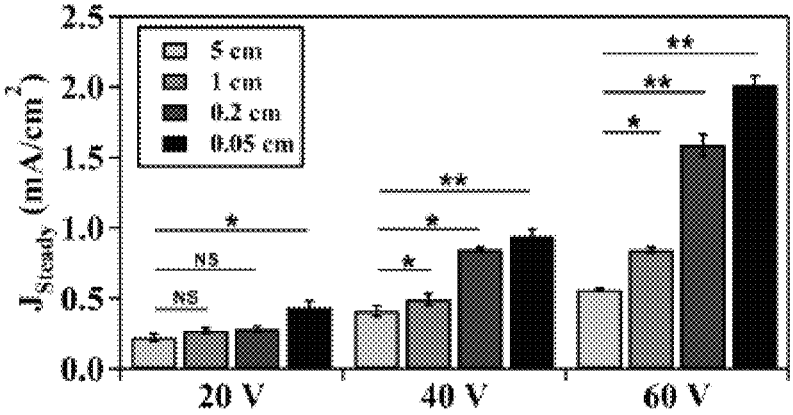

FIGS. 16A-16B show electrode distance (d) regulates current density (J) during the anodic growth of $TiO_2$ nanotubes. FIG. 16A shows change of current density with electrode distance when anodizing voltage is 60V. FIG. 16B shows the dependence of steady-state current density on d at different anodizing voltages. $^{**}P<0.01$ was calculated based on paired t-test analysis.

Figure 17A:
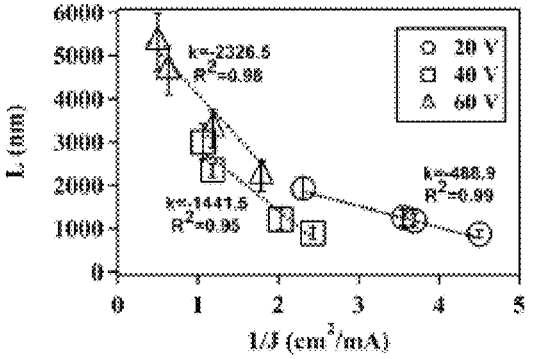
FIGS. 17A-17C shows inverse of the current density (J) correlates linearly with the structure of $TiO_2$ nanotubes.
Figure 17B:
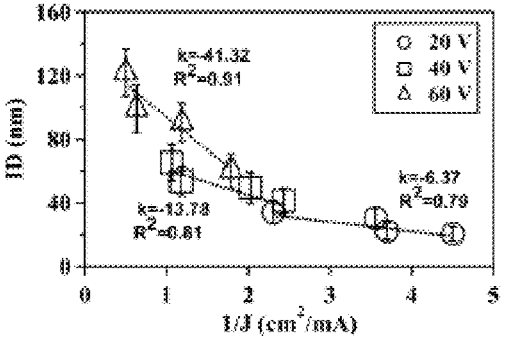
Figure 17C:
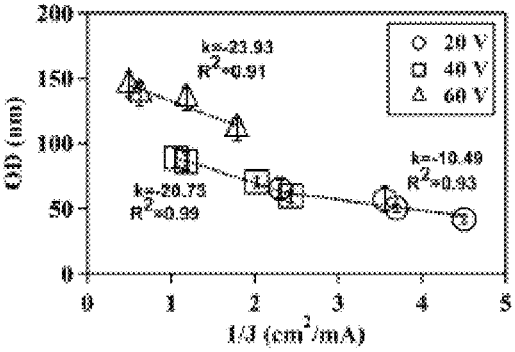

FIGS. 17A-17C shows inverse of the current density (J) correlates linearly with the structure of $TiO_2$ nanotubes. The dependence of FIG. 17A length (L), FIG. 17B inner diameter (ID) and FIG. 17C outer diameter (OD) of $TiO_2$ nanotubes on 1/J at an anodizing voltage of 20, 40, or 60V.

The invention will be further illustrated with reference to the following specific examples. It is understood that these examples are given by way of illustration and are not meant to limit the disclosure or the claims to follow.

Example 1

An assembled microfluidic device was fabricated for growing and regulating titanium dioxide ($TiO_2$) nanotubes in flow condition, as shown in FIGS. 1A-1M. The device is composed of six parts: Ti substrate (Anode) with microchannel pattern, polyacrylate (PA) insulating layer with microchannel pattern, Platinum (Pt) as cathode, polycarbonate top cover, metal screws and polyethylene tubing. The microchannel on Ti substrate was fabricated using Bridgeport Vertical Milling machine with 500 μm and 50 μm for width and height respectively. The other parts were engineered through either machining or laser cutting. Different parts were assembled into an integrated device by using screws.

Electrolyte solution was injected at flow rate of 1, 10, 100, or 200 μl/min through the microchannel via tubing and syringe pump. As a result, the thickness of oxide layer on top of the nanotubes and the percentage of oxide coverage were found to decrease with the increasing flow rates. In addition, the dimensions including the inner diameter and length of nanotubes were improved by applying flow condition at increasing flow rate, for example, the length was increased up to about 4000% as the flow rate increased from 0 to 200 μl/min. Moreover, flow condition was able to regulate the crystal orientation during the X-ray diffraction measurements and the crystal growth of nanotubes produced at flow condition is preferentially oriented along the [001] direction. Collectively, the structural (e.g., length and diameter) and material (e.g., crystal orientation) properties of $TiO_2$ nanotubes can be controlled by changing the magnitude of flow rate in microfluidics during anodization.

Example 2

During the anodization in microfluidic device, current-time curves particularly at high flow rate showed the typical patterns of the anodic growth of $TiO_2$ nanotubes, as shown in FIGS. 2A-2D. Without the change of the applied voltage, we showed that the steady-state current changed with flow rate and increased linearly with Peclet number (Pe). High Pe indicates a convection-dominated mass transport process. Because the length of the nanotubes correlates with the steady-state current, the increased steady-state current with Pe suggests that convective flow on the top of nanotube arrays plays a role in the regulation of key transport processes that are important to the growth of $TiO_2$ nanotubes.

Example 3

During the anodization of TiO2 nanotubes in microfluidic device, flow velocity profile was found to be able to regulate the dimension of nanotubes, as shown in FIGS. 3A-3J. When the height of the channel in the z direction is larger than the width of the channel in they direction, the velocity profile of the flow (in the x direction) is parabolic in the x-y plane with the highest flow velocity in the middle of the channel. As a result, nanotubes in the middle of channel were produced with larger inner diameter and length. When the height of channel is reduced while keeping the width of the channel unchanged, the parabolic flow profile switched from the x-y plane to the x-z plane and left a relatively uniform velocity distribution in the x-y plane. Thus the nanotubes could be produced with relatively uniform inner diameter and length across the channel. Collectively, the spatial distribution of nanotube structure in microfluidics can be controlled by manipulating the flow velocity profile during anodiazation.

Example 4

A conductive silicon substrate ($\Omega=1-5\times10^{-3}$ Ohm-cm) with the deposition of a 500 nm thickness metallic Ti thin-film was used as substrate instead of Ti substrate for the anodization in microfluidics as shown in FIGS. 4A-4H. Nanotubes could be controllably patterned into different geometries through using photolighrgraphy and the nanotubes were fabricated with an average diameter and length of 78 nm and 304 nm, respectively. Remarkably, when $TiO_2$ nanotubes were anodized microfluidically on a Ti thin-film (1 μm thick) that was deposited on a non-conductive silicon substrate ($\Omega=1-2\times10^{4}$ Ohm-cm), horizontally-aligned nanotubes relative to the silicon substrate were produced inside the walls of the channel while vertically-aligned nanotubes were present in the center of the channel. In addition, the inner diameter and density of horizontally-aligned nanotubes increased with flow rate. Therefore, the alignment of nanotube growth in microfluidics can be regulated when a Ti-coating non-conductive silicon substrate is applied.

Example 5

Characterization of $TiO_2$ nanotubes using energy dispersive X-ray spectroscopy (EDS) was conducted to determine the elemental property of nanotubes, as shown in FIGS. 5A-5C. Green color represents oxygen (O) element in the sample and the intensity of Ti and O element at different energy levels was evaluated. The Ti/O ratio is estimated to be 1:2 from the ratio of the peak height of O (0.452 keV) and Ti (0.523 keV).

Example 6

The thickness of oxide layer on the top of $TiO_2$ nanotubes was found to be able to minimize by increasing flow rate in microfluidics device. The SEM images of FIGS. 6A-6B show the different of oxide layer when flow rates are 1 μl/min and 200 μl/min, respectively.

Example 7

$TiO_2$ nanotubes produced through anodization in microfluidic device perform homogenous inner diameter, as shown in FIGS. 7A-7E.

Example 8

The spatial growth of $TiO_2$ nanotubes at upstream and downstream of microfluidic device shown in FIG. 8A that has the height of 2050 μm. Nanotubes were produced with increased length when anodized in device with high channel, as shown in FIGS. 8B-8C.

Example 9

The spatial growth of $TiO_2$ nanotubes at upstream and downstream of microfluidic device shown in FIG. 9A that has the height of 150 μm. Nanotubes were produced with relatively homogenous length, as shown in FIGS. 9B-9C.

Example 10

Horizontal growth of $TiO_2$ nanotubes on non-conductive silicon substrates can be achieved by applying 200 μl/min flow rate in different setup, including single microfluidic channel with 500 nm thickness of Ti coating, double microfluidic channel with 1 mm distance and 500 nm Ti thickness, and single microfluidic channel with photoresist patterned on the top, as shown in FIGS. 10A-10C.

Example 11

Horizontal growth of $TiO_2$ nanotubes cannot be achieved by using conductive silicon substrate, as shown in FIG. 11.

Example 12

Horizontal growth of $TiO_2$ nanotubes only formed in the wall area instead of center of the microchannel, as shown in FIG. 12A-12B.

Example 13

Horizontal growth of $TiO_2$ nanotubes is anodizing time-dependent. 5 minutes anodization is not long enough for forming horizontal aligned nanotubes, as shown in FIG. 13.

Example 14

This example investigates the effect of electrode distance on the anodic growth of $TiO_2$ nanotubes and show that the length and diameter of nanotubes change with the decrease of electrode distance. At elevated anodizing voltages, the change of the length and diameter of nanotubes becomes more sensitive to the change of electrode distance. These results reveal previously unidentified effect of electrode distance on the growth of $TiO_2$ nanotubes and thus provides an approach to enhance the growth of $TiO_2$ nanotubes without increasing the applied electric voltage or changing the electrolyte composition. The developed approach may find applications in the development of $TiO_2$ nanotube-based micro-devices for sensing, photocatalysis, and biomedical engineering.

Materials.

0.5 mm thick titanium film (99.2% pure) and 0.001" thick platinum (Pt) film (99.9% pure) were purchased from Alfa Aesar (Ward Mill, Mass.). The electrolyte solution for anodization was prepared by mixing 15 wt % $NH_4F$ (Sigma Aldrich) and 3 ml DI water with 145 ml Ethylene Glycol (VWR). HCl (37%) was purchased from Sigma Aldrich. The same electrolyte solution was used for Examples 1-13.

Instruments.

Electric power supply (TKD-Lambda) was used to conduct electrochemical anodization. The current density during anodization was recorded by BenchVue software. High resolution image of $TiO_2$ nanotubes were captured by Scanning electron microscope (FIB-SEM, Zeiss Cross Beam).

Electrochemical Anodization.

Ti and Pt films were submerged in the electrolyte solution in a beaker. Titanium film was connected to the power supply as the anode, whereas the cathode was clicked on Pt film. Distances between Ti and Pt films were controlled at 5, 1, 0.2, or 0.05 cm during anodization. The applied voltage between the anode and cathode was controlled at 20, 40 or 60V for each electrode distance. Anodization was conducted for 30 min at room temperature (25° C.) for all experiments.

Imaging and Statistical Analysis.

The $TiO_2$ samples were etched with HCl for 2-5 min and then cleaned with acetone before SEM imaging. Image J was used to calculate the length and diameter of $TiO_2$ nanotubes based on SEM images. To determine significant differences of data between experimental parameters, Student's t-test was performed where $P<0.05$ was considered significant. Each set of experiment was conducted for more than three times. The data was expressed as mean+/−standard deviation.

The anodic growth of $TiO_2$ nanotubes was conducted in a static bath with an electrolyte that contained ethylene glycol and $NH_4F$ (FIG. 14A). Platinum foil was used as the cathode and titanium foil served as the anode. We kept the composition of electrolyte and anodization time (30 min) same for all experiments and decreased the distance between the anode and cathode at constant anodizing voltages. FIGS. 14B and 14C showed typical SEM images of, respectively, the top and side views of $TiO_2$ nanotubes produced at 60V with varied anode-to-cathode distances. Evidently, both the diameter and the length of nanotubes increased with the decrease of electrode distance. In addition, the effect of electrode distance on the length of nanotubes became more significant when the magnitude of the anodizing voltage increased. For example, the electrode distance did not significantly affect the growth of nanotubes when the anodizing voltage is 20V (except when the electrode distance decreased to 0.05 cm ($P<0.05$)) (FIG. 15A). However, the length of nanotubes increased significantly with decreased electrode distance when the anodizing voltage was 40V and 60V. The effect of electrode distance on the inner and outer diameter of nanotubes has the similar trend (FIGS. 15B and 15C), suggesting a regulatory role of electrode distance in the growth of $TiO_2$ nanotubes.

The anodizing current density was examined at different electrode distances to explore why the electrode distance affects the growth of nanotubes. FIG. 16A showed the current-time characteristics of anodization at 60V at different electrode distances. Current-time curves showed typical patterns of growing nanotubes and the magnitude of steady state current density increased with the decrease of electrode distance (FIGS. 16A and 16B). Such increase of current density at a constant voltage could be attributed to the increase of electric field ($E=V/d$, where E is electric field, V is voltage, and d is the electrode distance) at a decreased electrode distance. Because the magnitude of steady state current density correlates positively with the length of nanotubes, the increased current density at a short electrode distance may contribute to the observed effect of electrode distance on the length of nanotubes (FIG. 15A). Increased current density could also cause a rapid electrochemical dissolution and lead to the widening of the pore structures and thus produce nanotubes with enlarged diameters. Collectively, it is likely that decreasing the electrode distance results in a significant increase of electric field and consequently an increased current density, which in turn promotes the electrochemical dissolution process and helps nanotubes to penetrate into the oxide layer in a more effective manner.

In addition, because elevated voltages will increase the current density at a constant electrode distance, decreasing of electrode distance at high voltages can further increase the current density and thus impact the nanotube structure more effectively. Indeed, when correlating the nanotube diameter and length with the steady current density at different electrode distances and voltages (FIG. 17A), the length of nanotubes changed linearly with the inverse of current density and the slopes of these linear regression increased with the increase of voltage (e.g., 489, 1442, and 2327 nA/dm for at 20V, 40V and 60 V, respectively), demonstrating that the growth of nanotubes is more sensitive to the change of electrode distance at high voltages. Similar trend was found for the inner (FIG. 17B) and outer diameter (FIG. 17C). These results thus demonstrate that the anodic growth of $TiO_2$ nanotubes is enhanced at decreased electrode distances and the growth of $TiO_2$ nanotubes is sensitive to electrode distances at high voltages.

Although various embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed:

1. A method for growing nanotubes via flow-regulated electrochemical anodization, comprising:

flowing in a laminar flow an electrolyte between a metal anode and metal cathode within a channel up to 500 microns wide, wherein the distance between the anode and cathode is from 150 microns to 2050 microns;

providing an electrical current across the anode and cathode sufficient to cause electrochemical anodization growth of nanotubes on a surface of the anode; and controlling a rate of the laminar flow to effect a desired growth of the nanotubes in a laminar flow region, wherein the laminar flow comprises a flow rate having a Peclet number of above 100 sufficient to inhibit growth of an oxide layer on the nanotubes.

2. The method of claim 1, wherein the flow is a microfluidic flow.

3. The method of claim 1, wherein the metal cathode comprises Pt.

4. The method of claim 1, wherein the metal anode comprises titanium, aluminum, vanadium, zirconium, hafnium, niobium, tantalum, or tungsten.

5. The method of claim 1, wherein the nanotubes comprise $TiO_2$.

6. The method of claim 1, wherein the flow rate is controlled to determine the length of the nanotubes.

7. The method of claim 1, wherein the flow rate is controlled to determine the inner and outer diameter of the nanotubes.

8. The method of claim 1, wherein the laminar flow comprises a flow profile which is controlled to determine the distribution of the nanotubes within the channel.

9. The method of claim 1, wherein the laminar flow comprises a Reynolds number of below about 2000.

10. The method of claim 1, wherein the flow rate comprises a Peclet number of above about 1000.

* * * * *